US006457338B1

(12) United States Patent
Frenken

(10) Patent No.: US 6,457,338 B1
(45) Date of Patent: Oct. 1, 2002

(54) PRESSING TOOL WITH PRESSING JAWS

(75) Inventor: Egbert Frenken, Wermelskirchen (DE)

(73) Assignee: Gustav Klauke GmbH (DE)

( * ) Notice: Subject to any disclaimer, the term of this patent is extended or adjusted under 35 U.S.C. 154(b) by 0 days.

(21) Appl. No.: 09/678,440

(22) Filed: Oct. 2, 2000

(30) Foreign Application Priority Data

Oct. 15, 1999 (DE) ..... 199 49 703
Mar. 3, 2000 (DE) ..... 100 10 601

(51) Int. Cl.[7] ..... B21D 39/04

(52) U.S. Cl. ..... 72/20.1; 72/30.1; 72/409.19; 72/416; 29/708; 29/720

(58) Field of Search ..... 72/30.1, 20.1, 72/31.01, 21.3, 416, 409.19; 29/702, 708, 720; 81/313

(56) References Cited

U.S. PATENT DOCUMENTS 2,931,260 A * 4/1960 Townshend ..... 81/313
5,490,406 A * 2/1996 College ..... 72/30.1
6,044,681 A 4/2000 Frenken ..... 72/237
6,164,106 A 12/2000 Nghiem et al. ..... 72/20.1
6,202,290 B1 * 3/2001 Kewitz ..... 29/702
6,240,626 B1 * 6/2001 Nghiem ..... 29/702

FOREIGN PATENT DOCUMENTS

DE 29602238 5/1996
DE 19631019 8/1997

* cited by examiner

*Primary Examiner*—Daniel C Crane
(74) *Attorney, Agent, or Firm*—Trexler, Bushnell, Giangiorgi, Blackstone & Marr, Ltd.

(57) ABSTRACT

The invention relates to a pressing tool (1) with pressing levers (2) which are connected to one another by a connecting link plate (7, 8) such that they can be rotated in a tong-like manner and each of which each provides an upper, free mouth end (14, 16), there being provided a monitoring device (13) which only allows an open position of the pressing levers (2) which is suitable for the release of a blank (42) to be achieved if a full pressing action, with a minimum closing position of the pressing levers (2) being achieved in the process, has been carried out beforehand, a mechanical, electronic or electrical sensor (15) being disposed on one of the pressing levers (2) for the purpose of checking the relative positioning of the pressing levers (2) in relation to one another. In order to achieve an improvement, it is proposed that the sensor (15) be disposed in the upper, free mouth end (14) of the one pressing lever (2).

37 Claims, 22 Drawing Sheets

II
II
1
2
3
4
5
6
7
8
10
11
12
13
14
15
16
17
18
19
20
21
22
23
24
25
26
27
28
29
30
34
35
36
37
38
39
40
41
46
52
53
54
55
57
58

2
38
47
41
7
3
43
45
40
44
46
36
37
35
33
25
27
28
29
30
26
23
22
14
24
15
13
12
17
20
16
19
18
31
32
34
42

41
40
47
7
3
2
43
38
44
36
37
35
33
25
28
27
29
30
26
23
22
24
14
15
71
13
12
42
72
17
16
20
19
18
31
32
34
45
46

PRESSING TOOL WITH PRESSING JAWS

RELATED/PRIORITY APPLICATION(S)

This application claims priority from German Application No. 199 49 703.6, filed on Oct. 15, 1999, and German Application No. 100 10 601.3, filed on Mar. 3, 2000.

The invention relates first of all to a pressing tool with pressing levers which are connected to one another by a connecting link plate such that they can be rotated in a tong-like manner and each of which provides an upper free mouth end, there being provided a monitoring device which only allows an open position of the pressing levers which is suitable for the release of a blank to be achieved if a full pressing action, with a minimum closing position of the pressing levers being achieved in the process, has been carried out beforehand, a mechanical, electronic or electrical sensor being disposed on one of the pressing levers for the purpose of checking the relative positioning of the pressing levers in relation to one another.

Pressing tools of this type are known, radial pressing of blanks, for example sanitary fittings, that is to say the reduction in the tube or sleeve diameter, usually taking place by means of pressing tools with pressing levers and/or pressing jaws which are moved towards one another via cam tracks, located at the end located opposite a pressing jaws, and associated rollers of a conventional pressing machine. The operation of monitoring whether pressing has taken place in full proves problematic in the case of the radial pressing. In order to achieve the desired profile depth, full closure of the pressing jaws is necessary. An incomplete pressing action may have its basis, for example, in the power of the drive being too low. Furthermore, deformations or rupturing of the pressing jaws and/or pressing levers or damage to the pressing tool may result in incomplete closure of the pressing jaws. In this respect, different solutions for monitoring the pressing action which aim for interaction between drive machine and pressing jaws are known. It is thus known, for example, to provide a pressing jaw with a gap sensor which senses the closing position of the pressing jaw on the inner side remote from the mouth end and transmits a corresponding signal to the machine, which reacts suitably. Further solutions operate with a coding of the pressing jaws for example by magnets. In this case, monitoring of the position of the pressing jaw and of the associated end positions of the machine rollers is carried out by the machine, for which purpose it is necessary to have a displacement-measuring mechanism and evaluating logic system in the machine.

In relation to the prior art described above, a technical problem of the invention is seen as the provision of a pressing tool with pressing levers of the type in question which is improved as far as monitoring a full pressing action is concerned.

This problem is solved at least and in essence in the case of the subject matter of claim 1, this being based on the fact that the sensor is disposed in the upper free mouth end of the one pressing lever. As a result of this configuration, the closing position of the pressing lever and/or jaws in the region of the upper, free mouth ends, which are to be moved towards one another, is monitored. The pressing jaws are thus reliably monitored to the effect that they are fully closed towards the end of a pressing action. The sensor provided monitors here the spacing between the two mouth ends and only when a preferably fully closed position of the pressing jaws is achieved, that is to say when the mutually facing surfaces of the upper, free mouth ends, which are substantially the furthest away from the centre of rotation, butt against one another, does it allow an open position of the pressing jaws which is suitable for the release of a blank.

Since the sensor, for sensing the pressing-jaw position, is disposed in the region of the upper, free mouth end of a pressing lever, it is ensured, in contrast to the known solutions, that any rupturing of the pressing levers or pressing jaws in the front region is sensed since, in this case, there is no contact between the front ends, that is to say the upper, free mouth ends. It is preferred that, during a pressing operation, once a predetermined closing angle of the pressing levers in relation to one another has been achieved, opening of said levers for the release of the blank can only take place following full pressing action, that is to say following full closure of the pressing jaws. Accordingly, as from the predetermined closing-angle position, a full pressing action of the blank is absolutely necessary in order for the pressing tool to be removed thereafter. Such a principle is known in manual pressing tools, for example crimping tongs. These can only be opened again once the closed position has been achieved. The blocking mechanism used in these tongs preferably reacts to the angle position of the tool/tong handles. Since use is mostly made of a toggle-lever mechanism, a relatively precise check of the closed tongs is achieved, in this construction, even in the case of a relatively imprecise blocking catch. Since, in the case of the pressing levers which form the basis here, there is no such force enhancement, that is to say a lever advantage by virtue of toggle levers, the blocking mechanism has to be designed very precisely. This is achieved according to the invention by a division of the latching and blocking functions.

The invention also relates to a pressing tool with pressing levers which are connected to one another by a connecting link plate such that they can be rotated in a tong-like manner, with the interposition of a rolling body, and which define a mouth end, there being provided a monitoring device which only allows an open position of the pressing levers which is suitable for the release of a blank to be achieved if a full pressing action, with a minimum closing position of the pressing levers being achieved in the process, has been carried out beforehand, a mechanical release pin being disposed in one of the pressing levers for the purpose of checking the relative positioning of the pressing levers in relation to one another. In order to specify here a pressing tool with pressing levers of the type in question which is formed in improved manner as far as the monitoring of a full pressing action is concerned, it is proposed that the release pin interacts with a blocking slide which has a blocking pin, which blocking pin, if the pressing action is incomplete, prevents an opening movement of the pressing levers about the rolling body. As a result of this configuration, there is a mechanical locking if the minimum closing position of the pressing levers is not achieved. The sensor, which is disposed in the upper, free mouth of the one pressing lever, causes displacement of the blocking pin into the blocking position and securing of the blocking pin in this blocking position. The latter can be achieved, for example, in that the blocking pin engages in a recess of a tool which is secured in relation to the pressing lever or moves against the rolling body in the course of an attempted opening pivoting movement of the pressing lever.

The invention also relates to a pressing tool with pressing levers which are connected to one another by a connecting link plate such that they can be rotated in a tong-like manner and which define a -mouth end, there being provided a monitoring device which only allows an open position of the pressing levers which is suitable for the release of a blank to be achieved if a full pressing action, with a minimum closing position of the pressing levers being achieved in the process, has been carried out beforehand, a mechanical sensor being disposed in one of the pressing levers for the purpose of checking the relative position of the pressing levers in relation to one another, the mechanical sensor, in the case of incorrect closure of the pressing levers, triggering a mechanical locking mechanism in the region of the connecting link plate. In order to provide here a pressing tool with pressing levers of the type in question which is improved as far as the monitoring of a full pressing action is concerned, it is proposed that the locking mechanism be covered towards the outside by the connecting link plate. As a result of this, the locking mechanism, i.e. the means for blocking movement of the pressing levers into the open position, is positioned in a concealed location beneath the connecting link plate and, accordingly, protected against contamination and unauthorized manipulation. Furthermore, by virtue of this arrangement of the locking mechanism in the vicinity of the point of rotation, the lever forces acting on the components, in particular blocking pin, which bring about the locking action are kept low, this counteracting overloading of the blocking element or fatigue of the material of the same.

The invention additionally relates to a pressing tool with pressing levers which are connected to one another by a connecting link plate such that they can be rotated in a tong-like manner and each of which provides an upper, free mouth end, there being provided a monitoring device which only allows an open position of the pressing levers which is suitable for the release of a blank to be achieved if a full pressing action, with a minimum closing position of the pressing levers being achieved in the process, has been carried out beforehand, a mechanical, electronic or electrical sensor being disposed on one of the pressing levers for the purpose of checking the relative positioning of the pressing levers in relation to one another. According to the invention, a pressing tool with pressing levers of the type in question is advantageously developed to the effect that the monitoring device is disposed in its entirety in the interior of a pressing lever. As a result of this configuration, the monitoring device is advantageously protected against contamination and damage from the outside.

The invention also relates to a pressing tool with pressing levers according to the preamble of claim 1 in which in this case, for the advantageous development of a pressing tool of the type in question, it is proposed that the monitoring device be disposed in a sunken or planar manner in relation to the outer surface of the pressing lever, as a result of which the monitoring device does not adversely affect the thickness of the pressing-jaw.

The invention additionally relates to a pressing tool with pressing levers according to the preamble of claim 1. In order advantageously to develop a pressing tool of the type in question, it is proposed that the sensor, with the possible exception of a sensor tip, be disposed in the interior of a pressing lever. As a result of this configuration, the sensor is kept in a concealed position and is protected against damage and contamination. If appropriate, merely a sensor tip projects beyond the outer surface of the pressing lever.

The invention also relates to a pressing tool with pressing levers according to the preamble of claim 1 in which, for the advantageous development of the same, it is proposed that the sensor be disposed in a sunken or planar manner in relation to the outer surface of the pressing lever.

Irrespective of the configuration of the pressing tool according to the invention, it is also proposed that the sensor or the release pin be disposed in the upper, free mouth end of the one pressing lever. In the case of a pressing tool according to the invention in which the pressing levers are connected to one another such that they can be rotated in a tong-like manner, with the interposition of a rolling body, it is advantageously provided that the sensor or the release mechanism interacts with a blocking slide which has a blocking pin, which blocking pin, if the pressing action is incomplete, prevents an opening movement of the pressing levers about the rolling body. It is also advantageous, in the case of pressing tools of the type in question in which the sensor or the release mechanism, in the case of incorrect closure of the pressing levers, triggers a locking mechanism in the region of the connecting link plate, for the locking mechanism to be covered towards the outside by the connecting link plate. It is also advantageous for the monitoring device to be disposed in its entirety in the interior of a pressing lever. In addition, provision may also be made for the monitoring device to be disposed in a sunken or planar manner in relation to the outer surface of the pressing lever. In an advantageous development, provision is made for the sensor, with the possible exception of a sensor tip, to be disposed in the interior of a pressing lever. It is also proposed that the sensor be disposed in a sunken or planar manner in relation to the outer surface of the pressing lever. It proves advantageous for the sensor, if the pressing action is incomplete, to trigger mechanical blocking between the connecting link plate and the one pressing lever. As a result of this, the pressing lever which can be pivoted about a pin secured in the connecting link plate is blocked mechanically against the connecting link plate, which is stationary in relation to said pressing lever, said blocking action being brought about, for example, by means of a blocking element which is disposed in the preferably sensor-accommodating pressing lever and interacts with the connecting link plate for blocking purposes. In a preferred configuration, provision is made in this respect for a blocking slide to be disposed in the one pressing lever, with a blocking pin projecting in a recess of the connecting link plate, and for the blocking pin, if the pressing action is incomplete, to run against a blocking projecting portion in the recess of the connecting link plate. It is preferable here for the blocking slide, with the blocking pin, to be disposed in a concealed position of the pressing lever, with the blocking pin, in an overlap region of pressing lever and connecting link plate, projecting out of the pressing lever into the recess which is formed in this overlap region on that side of the connecting link plate which is directed towards the pressing lever. Said recess is preferably formed in a link-like manner, with a blocking projecting portion which can also preferably be overrun by the blocking pin during the pivoting movement of the pressing levers. If the pressing action is incomplete and an attempt is then made to open the pressing levers, said blocking projecting portion stands in the way of the pivoting path of the blocking pin, which is coupled to the pressing lever, with the result that an opening pivoting movement of the pressing levers can be effected at least only over a relatively small angle range, said angle range not however allowing the release of the blank. Provision is also made for the blocking slide to project under biassing action into the blocking position of the blocking pin, and said biassing can only be released in the case of a full pressing action. For this purpose, the blocking slide is preferably subjected to the action of a spring which spring, at the same time, makes it possible for the blocking pin, in the course of a pivoting closing movement of the pressing levers, to overrun the blocking projecting portion within the recess of the connecting link plate. A tension spring is further provided in this respect. In the case of full, correct pressing action, the biassing of the blocking slide into the blocking position of the blocking pin can be released by the sensor, which is disposed in the upper, free mouth end of the one pressing lever, for the purpose of overrunning the blocking projecting portion of the recess during the opening pivoting movement of the pressing levers. It proves advantageous in this respect for the blocking slide to be subjected to the action of a latching pin which, in the case of full pressing action, displaces the blocking slide into the release position. In this way, the division according to the invention of the latching and blocking functions is achieved, provision also preferably being made for the latching pin to be biassed into the release position of the blocking slide, and, in the case of full pressing action, for the biassing to be relieved. It is preferably the case here that the latching pin is subjected to the action of a compression spring which is loaded in the course of an opening pivoting movement of the pressing levers, following a full pressing action. The force of the spring which acts on the latching pin is here selected to be greater than that of the spring, in particular tension spring, which biasses the blocking slide, with the result that the latching pin, biassed in this way, in the case of a full pressing action and the associated release of the same, displaces the blocking slide and its blocking pin into the release position counter to the blocking-slide biassing. As has already been mentioned, build-up of the biassing of the latching pin is effected preferably in the course of an opening pivoting movement of the pressing jaw, following a full pressing action, in the manner of an energy store. It is preferred here, during this opening pivoting movement of the pressing levers, for the blocking slide and its blocking pin to be supported on a flank of the connecting-link-plate recess and, via the blocking slide, for the latching pin to be displaced, in its bearing bore or the like, into a latching position counter to the force of the compression spring which acts on said latching pin. It is also preferred for the sensor, in the upper, free mouth end of the one pressing lever, to be formed by a section of an end release pin which is disposed in the region of the end surface directed towards the other pressing lever, and it is also proposed in this respect that the latching pin be urged, by the release pin, into a blocking position, in which the biassing is inhibited, and, when the release pin is subjected to the action of the other pressing jaw, that the biassing be relieved for the purpose of displacing the blocking slide into the release position. It proves particularly advantageous here for the release pin itself to be subjected to biassing which urges the latching pin into the latching position and can be applied, for example, by means of a compression spring. In the case of full closure of the pressing levers, in which the mutually facing end surfaces of the pressing levers come into abutment, the release pin is subjected to the action of the other pressing lever, preferably by means of the end surface thereof which is directed towards the one pressing lever, such that the release pin is moved counter to its biassing, with the result that the latching pin is displaced into the release position, for the purposes of forcing the blocking slide into a position in which the blocking between blocking pin and blocking projecting portion is released. It proves particularly advantageous for the free end surface of the release pin which is to be acted on to be set back from that end surface of the pressing lever which is directed towards the other pressing lever, and for the opposite end surface of the other pressing lever, which brings about the release, to have a corresponding elevation. This avoids the situation where the latching pin passes into the release position by way of accidental contact with the release pin. In addition, in a further configuration of the subject matter of the invention, provision is made for an adjustable stop for the release pin to be disposed in the other pressing lever, this enabling precision adjustment of the unblocked position. Provision may also be made for the latching pin to be formed in one piece with the blocking slide. Furthermore, in an alternative configuration of the subject matter of the invention, it is proposed that the release pin has a run-on slope associated with the latching pin for the purpose of displacing the latching pin and/or the blocking slide into the release position during a pressing action. Alternatively, the configuration may also be selected such that the latching pin, which acts on the blocking slide or is formed in one piece therewith, has a run-on slope which interacts with the release pin for the purpose of displacing the latching pin. In order to keep the latching pin and/or the blocking slide with the blocking pin in the release position following a full pressing action over the entire opening pivoting path of the pressing levers, latching of the latching pin and/or of the blocking slide is advantageously provided, it being possible, in an exemplary configuration, for this to be achieved such that the latching pin engages in a latching recess of the release pin following displacement into the release position, it being possible for said latching recess of the release pin to be, for example, in the form of an annular groove into which a tip of the latching pin and/or of the blocking slide penetrates. In this latching position, the release pin, which forms a mechanical sensor, has been moved away from the sensor position, i.e. it cannot be subjected to the action of the stop, which is disposed in the other pressing lever. This latching position of the release pin is only achieved again in the course of further opening pivoting movement of the pressing levers, for which purpose provision is advantageously made for the release pin to be biassed into a sensor position, i.e. into a position which is subjected to the action of the stop of the other pressing lever. As an alternative to the abovementioned configuration where the release pin is set back in relation to the free end surface of the pressing lever associated with the release pin and the opposite stop, which brings about the release, projects beyond the associated end surface of the pressing lever, it is proposed that, when the pressing levers are moved together, both the release pin and the stop project beyond the associated end surface. It is also proposed that the blocking pin be spring-biassed into the blocking position. It proves particularly advantageous for the release pin, which can be released at an angle to the blocking pin, to have a run-on slope which, in the case of full pressing action, moves the blocking pin into the release position, preferably counter to the abovementioned spring-biassing. The blocking pin or the blocking slide is preferably disposed here at an obtuse angle to the release pin, within a common plane. An obtuse angle of from 80° to 160° is preferred. It also proves advantageous for the blocking pin, in the release position, to be secured by latching, the latching of the blocking pin also being released during the opening movement for the purpose of reactivating the monitoring device. The mechanical locking of the pressing levers, if the pressing action is incomplete, is achieved in a configuration according to the invention in that said mechanical locking is achieved by a blocking pin which is guided in the pressing jaw and projects into a recess provided in that side of the connecting link plate which is directed towards the pressing jaw. Accordingly, the blocking pin interacts with a component of the pressing tool which is rotationally fixed in relation to the pressing levers—the connecting link plate—this configuration additionally providing for the locking mechanism to be covered towards the outside by the connecting link plate. If the pressing levers are connected to one another such that they can be rotated in a tong-like manner, with the interposition of a rolling body, then said rolling bodies are also overlapped by the connecting link plate. A further alternative locking method presents itself here, for which purpose it is proposed that associated recesses for the rolling body be formed in the pressing jaws, these leaving a free space between a recess and the rolling body during the closure of the pressing jaws, and that the blocking pin, which has moved into said free space, can only be moved into the release position by movement of the release pin which takes place during a full pressing action. Accordingly, following an incomplete pressing action, the blocking pin passes with blocking action into the free space between recess and rolling body, with the result that rotation of the pressing levers in the opening direction is prevented. In addition, it proves advantageous in this respect for two rolling bodies with associated recesses to be disposed one beside the other in the pressing jaws at different distances from the mouth. It is also proposed in this respect that the blocking pin interacts with the rolling body which is further away from the mouth. In order, following an incomplete pressing action and associated locking of the pressing levers, to enable removal of the pressing tool, for example in the case of damage to the blank or provision of an incorrect blank, in a further development of the subject matter according to the invention provision is made, following an incomplete pressing action, for it to be possible to achieve the release position of the blocking pin by an emergency unlocking action. This emergency unlocking action can preferably be carried out manually by the user. Provision is thus made for the emergency unlocking action to act on the release pin, which can displace the blocking pin into the release position. It is possible, for example, for an exposed handle connected to the release pin to be provided here. Alternatively, it is also possible for an emergency unlocking action to take place by displacement of the adjustable stop, which acts on the release pin. It is thus possible for an accompanying emergency unlocking handle to be fitted such that it acts rearwardly against the adjustable stop for the purpose of displacing the same in the direction of the release pin, as a result of which the latter is moved into the position in which the blocking pin is released. If the adjustable stop is in the form of an adjusting screw, said displacement for emergency unlocking purposes can be carried out by means of a rearwardly fitted screwing tool. It is also alternatively proposed for the emergency unlocking action to act directly on the blocking pin. It is thus possible, for example, for a handle, for emergency unlocking, to be associated with the release pin and/or the stop or the blocking pin, said handle accompanying the pressing tool as a loose part. Provision may also be made for the handle to be formed as an extension of the blocking pin and, for the pulling or pushing actuation of the blocking pin into the release position, to project laterally beyond the pressing lever. As a result of this configuration, the handle serving for emergency unlocking purposes is secured in captive fashion on the pressing tool, and, by virtue of the connection of the handle to the blocking pin, this, at the same time, provides a visual signal for registering the current position of the monitoring device. The pressing tool according to the invention formed in the manner described may, on account of the sensors and/or locking elements being disposed solely within it, be associated with a conventional, preferably electrically driven pressing machine. Alternatively, or even in combination therewith, provision may also be made for the sensor, which is disposed in the upper, free mouth end of the one pressing lever, to operate electrically or electronically. Until the full pressing action, i.e. until full closure of the mouth, takes place, an electric or electronic signal is supplied to the pressing machine acting on the pressing levers, or to the drive thereof, with the result that it is only following a full pressing action of a fitting or the like that said pressing machine switches off and moves back for the release of the pressing levers. This electronic control of the pressing machine via the electronic or electrical sensor disposed at the upper, free mouth end preferably operates in addition to the mechanical locking of the pressing levers. As a further configuration, a visual signal may be provided in the pressing tool in addition to mechanical locking and/or electronic sensor control of the pressing machine. It is thus possible for a part which is to be displaced preferably mechanically, thus, for example in the case of mechanical locking of the pressing levers, the blocking pin, to be visible, for example, through a viewing window, an initially visible, for example red-coloured, region indicating that the pressing action is incomplete. If this pressing action, in contrast, has been carried out correctly, then this results, via the sensor disposed in the upper, free mouth end, in a displacement of the part which can be seen through the window, for example the blocking pin, whereupon another, for example green-coloured, region becomes visible for the purpose of indicating this full pressing action. The entire mechanism is integrated in a pressing lever and, as a result, is protected against contamination. Any openings which may be necessary for the fitting of the mechanism or for emergency unlocking purposes are preferably closed. Alternatively, it is also possible for the mechanism to be protected against the penetration of dirt by cylindrical guides with narrow gaps. The mechanical monitoring device according to the invention can be used not just in the case of straightforward pressing jaws with fixed geometry but also in the case of closing jaws for closing-chain pressing tools and pressing jaws for exchangeable inserts.

The invention is explained in more detail hereinbelow with reference to the accompanying drawing, which illustrates merely a number of exemplary embodiments and in which:

FIG. 17 shows a perspective illustration of a pressing tool in a second embodiment;

Figures 1, 2:
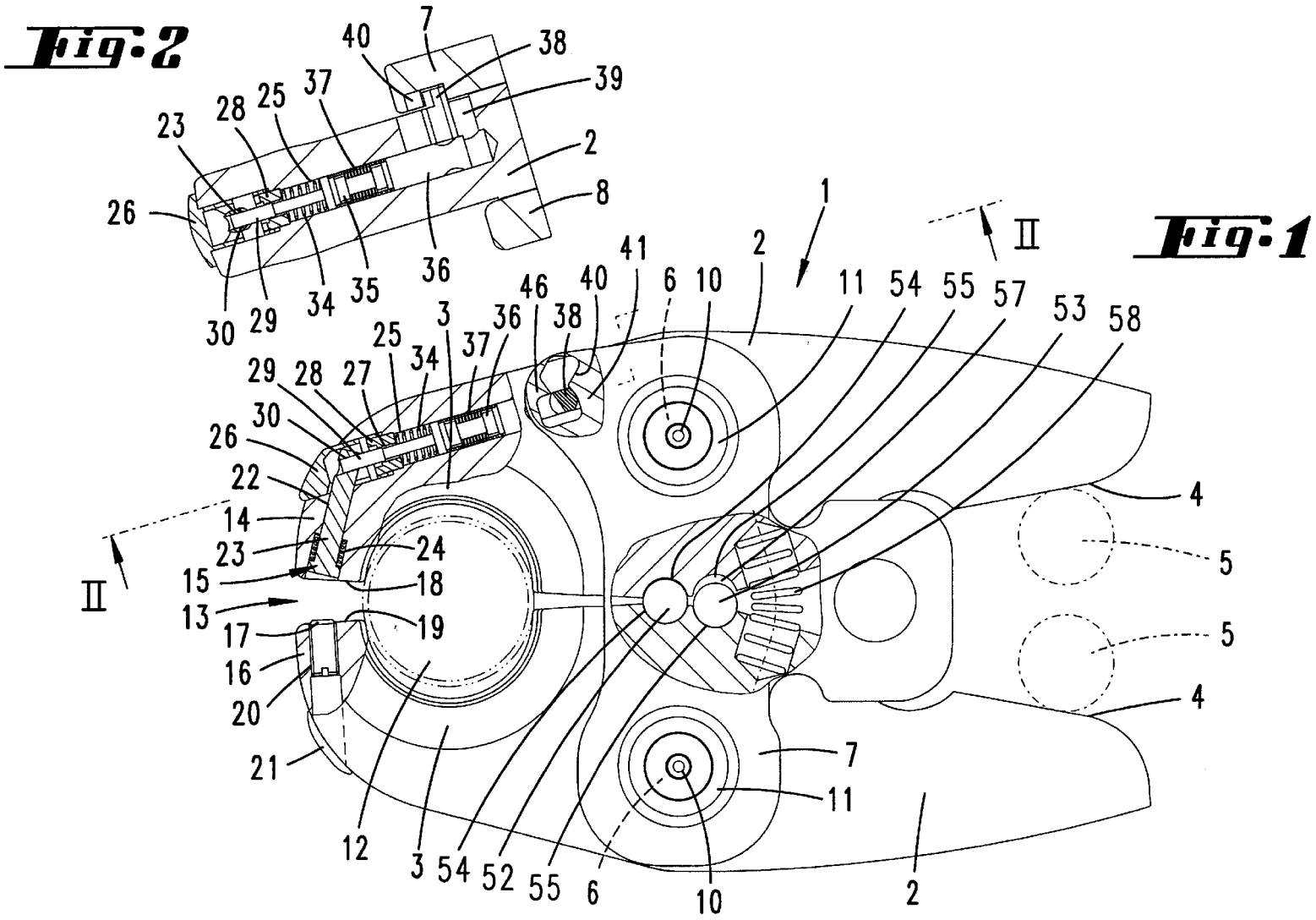
FIG. 1 shows a partially sectioned view of a pressing tool according to the invention with the monitoring device in an unblocked position.
FIG. 2 shows the section according to the line II—II in FIG. 1.
Figure 3:
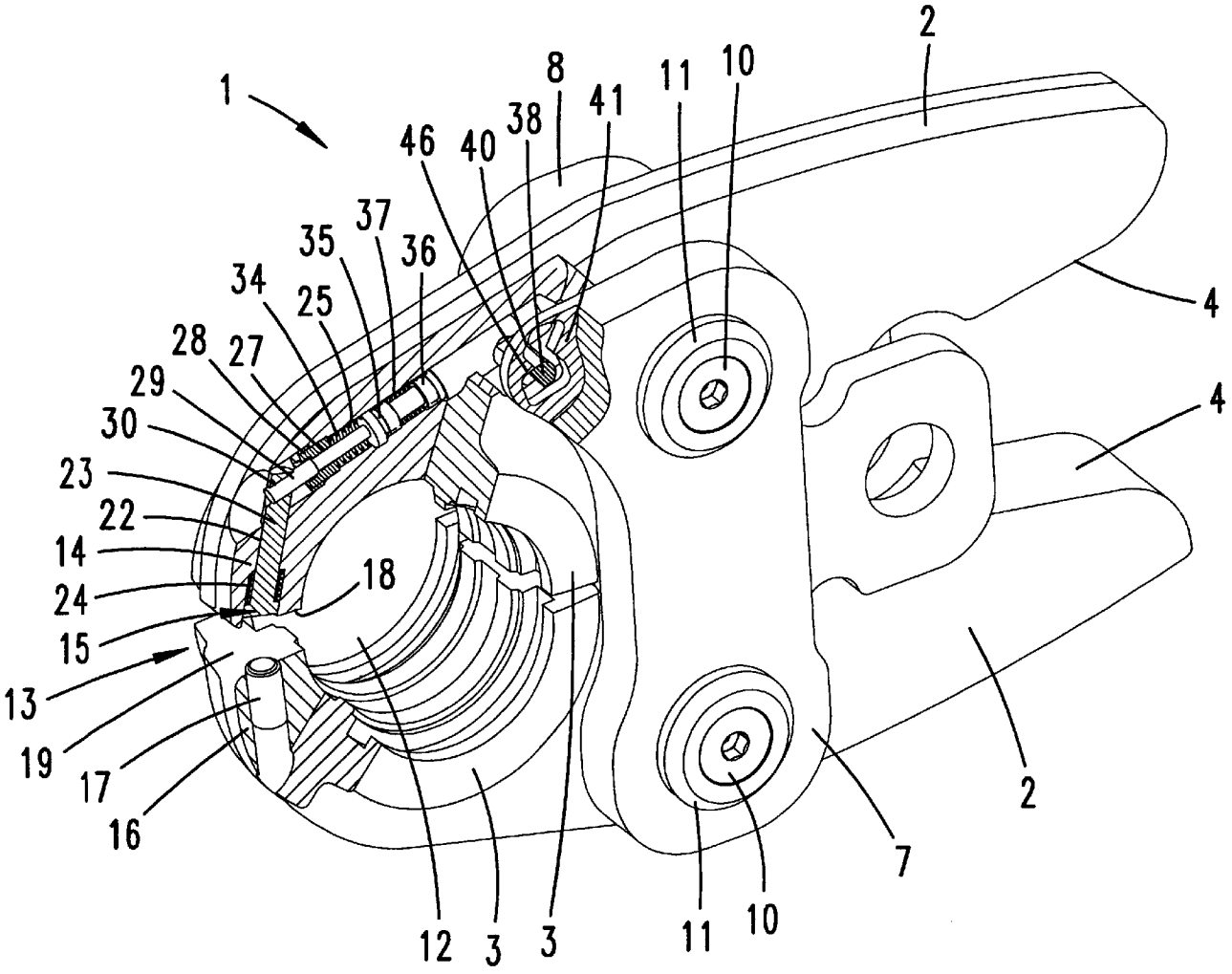
FIG. 3 shows the pressing tool, partially in section, in a perspective illustration.
Figure 4:
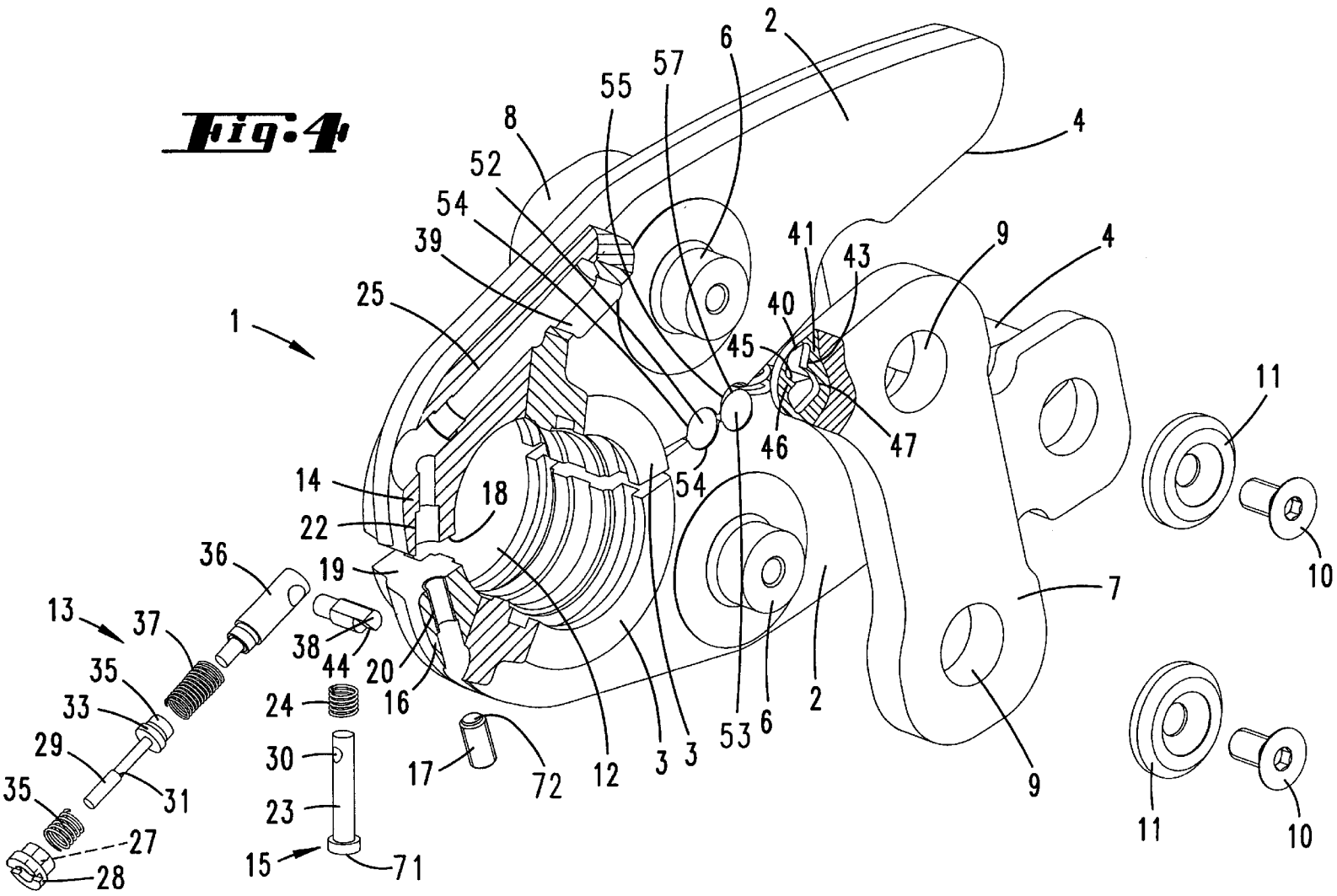
FIG. 4 shows an exploded illustration of the pressing tool.

A pressing tool 1 for pressing blanks 42, e.g. sanitary fittings or the like, is illustrated and described first of all with reference to FIG. 1.

This pressing tool 1 has, in conventional manner, two pressing levers 2, one end of each of which is formed as a pressing jaw 3. In the region of the ends which are located opposite the pressing jaws 3, the pressing levers 2 have cam tracks 4 for activation by schematically illustrated rollers 5 of a pressing machine (not illustrated).

For the tong-like action of the pressing levers 2, the latter are mounted pivotably between two connecting link plates 7, 8 by means of bolts 6. The bolts 6 pass through appropriately positioned bores 9 in the connecting link plates 7, 8. To prevent withdrawal, the bolts 6 are provided, at the surface of the connecting link plates 7, 8 which is directed away from the pressing levers 2, with collar-forming washers 11 which can be fastened on the bolt 6 by means of screws 10. The pressing levers 2 disposed in this way are connected to one another in a rotatable manner with the interposition of two rolling bodies 52 which are disposed one beside the other at different distances from the pressing mouth 12 and are covered towards the outside by the connecting link plates 7, 8, for which purpose recesses 54, 55 are formed in the pressing levers 2, these leaving a free space 56, 57 between the recesses 54, 55 and the rolling bodies 52, 53 during the closure of the pressing levers 2. Furthermore, the pressing levers 2 are forced towards one another in the closing direction by means of a compression spring 58 which is likewise overlapped by the connecting link plates 7, 8.

The pressing jaws 3 form a pressing mouth 12 which is circular in plan view in the closed position, each pressing jaw 3 having a mouth opening which is semicircular in plan view.

For the purpose of pressing, for example, a sanitary fitting on a tube, the pressing tool 1 is arranged such that the blank 42 is disposed in the region of the pressing mouth 12. The desired pressing action takes place by virtue of the pressing jaws 3, and thus the pressing mouth 12, being closed.

According to the invention, the closing position of the pressing jaws 3 and/or of the pressing levers 2 is monitored by means of a monitoring device 13, for which purpose one pressing lever 2 has a sensor 15 in the region of the upper, free mouth end 14 of the pressing jaw 3 and the other pressing lever 2 has an adjustable stop 17 in the region of its upper, free mouth end 16, it being possible for said stop to be associated with said sensor.

The monitoring of the closing position of the pressing levers 2 takes place in the region of the mutually facing end surfaces 18, 19 of the upper, free mouth ends 14, 16 of the pressing levers 2.

The stop 17 is seated in a threaded bore 20 of the mouth end 16 such that its body axis is aligned approximately perpendicularly to the associated end surface 19 of the mouth end 16. Furthermore, the arrangement is selected such that that end of the stop 17 which interacts with the sensor 15 (stop tip 72) projects beyond the end surface 19.

For fine position adjustment, it is possible to adjust the stop 17 in the threaded bore 20, said adjustment being carried out preferably by screw-action displacement of the stop 17 by means of a screwdriver acting at the rear. Once the desired position of the stop 17 has been found, fixing can take place thereafter, for example, by centre punching.

The threaded bore 20 is formed, in particular for fine position adjustment, as a through-passage bore. In order to counteract contamination of the threaded bore 20, the latter is preferably closed by a cap 21, for example a plastics cap.

The sensor 15 is formed as a release pin 23 which is guided in a bore 22 open in the direction of the end surface 18 of the one pressing lever 2. Said release pin 23 is biassed in the direction of the end surface 18 by means of a compression spring 24, one end of which is supported on a step of the bore 22.

That end of the release pin 23 which is directed away from the end surface 18 projects into a further bore 25, which encloses approximately an angle of 120° in relation to the bore 22.

This bore 25 is open in the direction of the side which is directed away from the connecting link plates 7, 8, it also being possible here, in order to avoid contamination, for a cap 26, preferably a plastics cap, to be fitted.

A cover 28 which has a central, stepped bore 27 is screwed into the bore 25 in a stop-limited manner. Projecting through the bore 27 of said cover is a latching pin 29, the upper, free end of which is located in a release bore 30 of the free end of the release pin 23.

Figure 8:
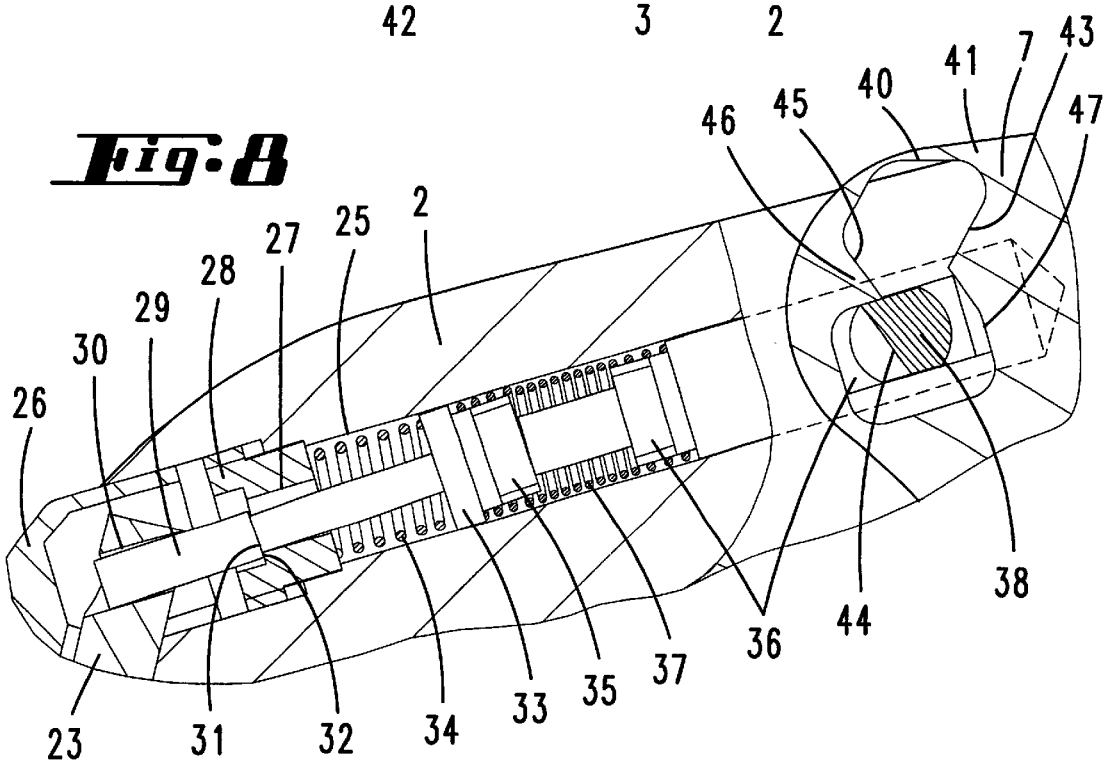
FIG. 8 shows an illustration in detail form from FIG. 7 illustrating the monitoring device in the blocking position.

As can be seen, for example, from the enlargement in FIG. 8, the upper, free end of the latching pin 29, said end being associated with the release bore 30, is of radially thickened form, for the purpose of forming a latching shoulder 31.

As has been mentioned, the bore 27 of the cover 28 is of stepped formation. The region that is directed towards the free end of the latching pin 29 has a larger diameter than the region which is directed away from the thick, free end, as a result of which a latching step 32 is formed.

At the end which is directed away from the release pin 23, the latching pin 29 is provided with a plate 33, the external diameter of which is selected to be somewhat smaller than the diameter of the bore 25. A compression spring 34, which encloses the latching pin 29, is disposed between this plate 33 and that end surface of the cover 28 which is directed towards the same, for the purpose of forcing the latching pin 29 in the direction of the connecting link plates 7, 8.

On the side which is directed away from the spring 34, the plate 33 is provided with an activating mandrel 35.

A blocking slide 36 is mounted in the bore 25, in extension of the latching pin 29, and is biassed against the latching pin 29 by a tension spring 37 which is held, at one end, on the blocking slide 36 and, at the other end, in the region of the activating mandrel 35 of the latching pin 29.

That end of the blocking slide 36 which is directed away from the latching pin 29 is provided with a blocking pin 38 which is aligned transversely to the alignment of the blocking slide 36 and, passing through a cutout 39 which is open in the direction of a surface of the pressing lever 2, engages in a recess 40 of an projecting portion 41 of the connecting link plate 7. This recess 40 is formed on that side of the connecting-link-plate projecting portion 41 which is directed towards the pressing lever 2, and according to the sectional illustrations shown, it has a link-like contour.

Figures 5, 6:
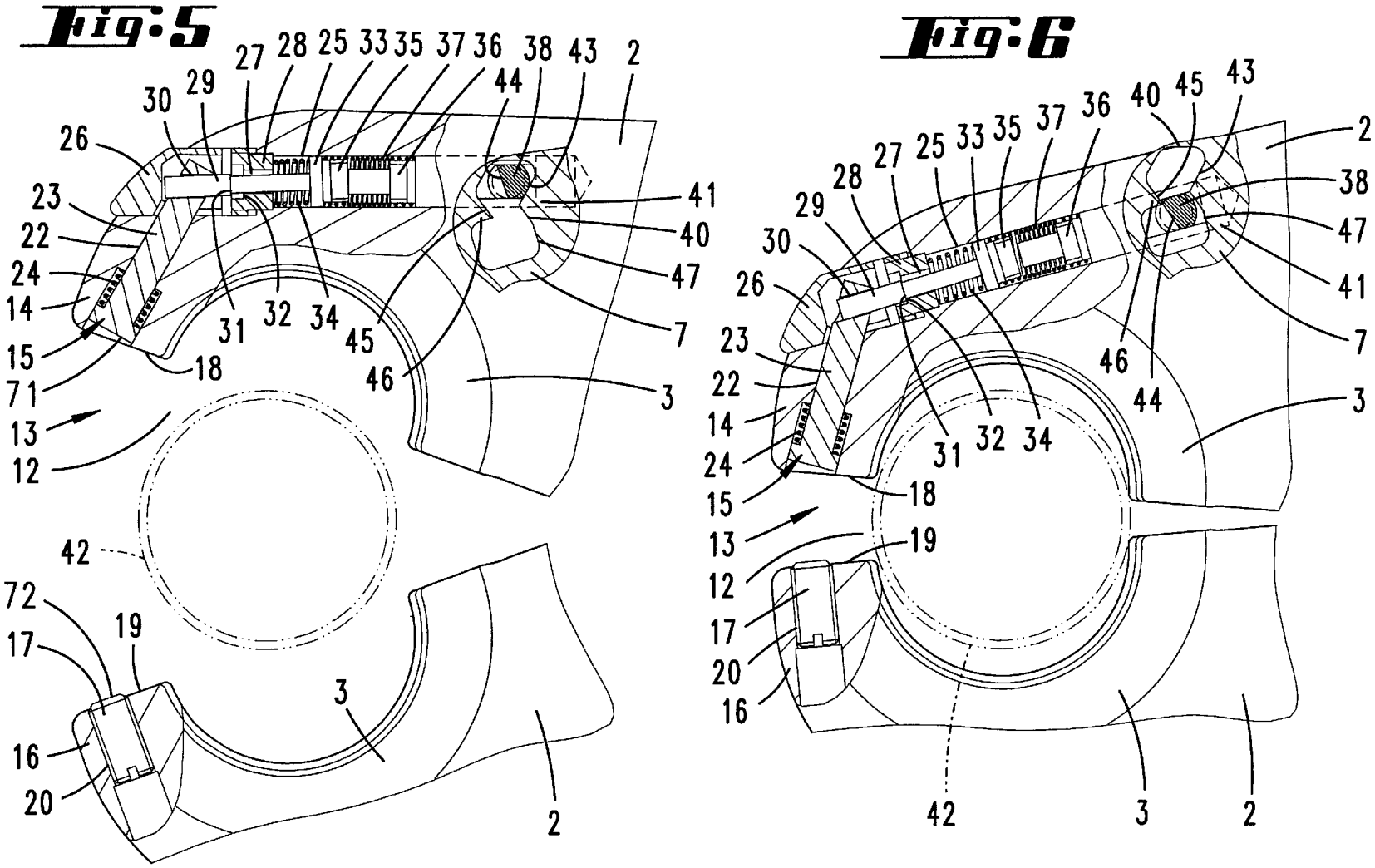
FIG. 5 shows an illustration in detail form of the pressing levers held in the open position.
FIG. 6 shows a follow-up illustration to FIG. 5 illustrating an intermediate position during a closing movement of the pressing levers.
Figure 16:
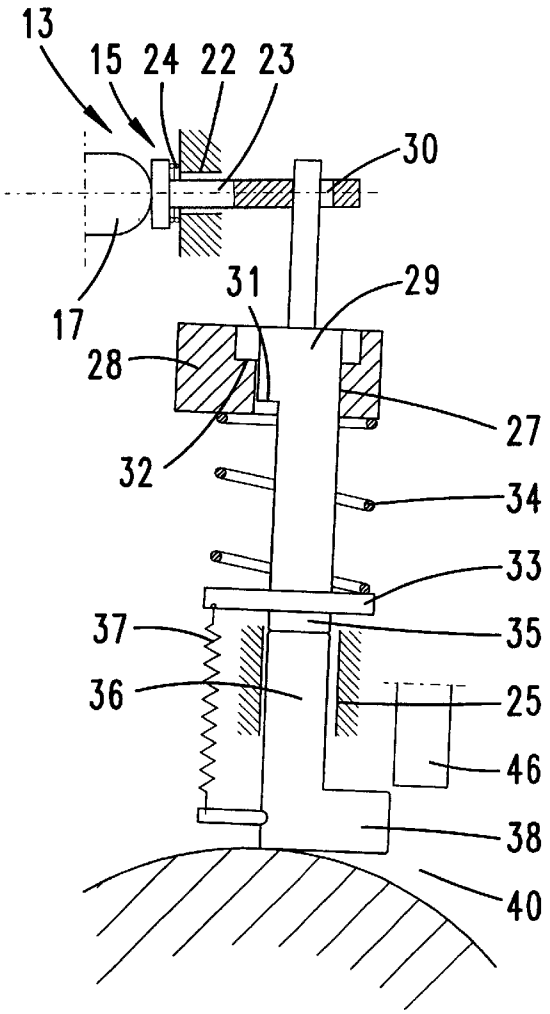
FIG. 16 shows the schematic illustration of the monitoring device in a position according to FIG. 9, with displacement of the blocking pin into the release position.
Figure 15:
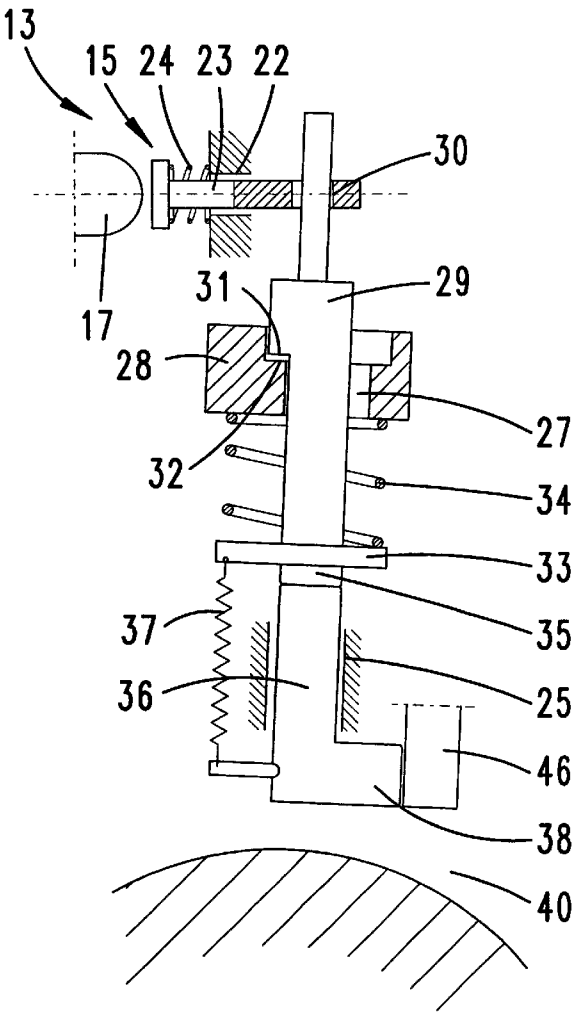
FIG. 15 shows the schematic illustration in a position of the monitoring device according to FIG. 6, that is to say in the blocking position.
Figure 14:
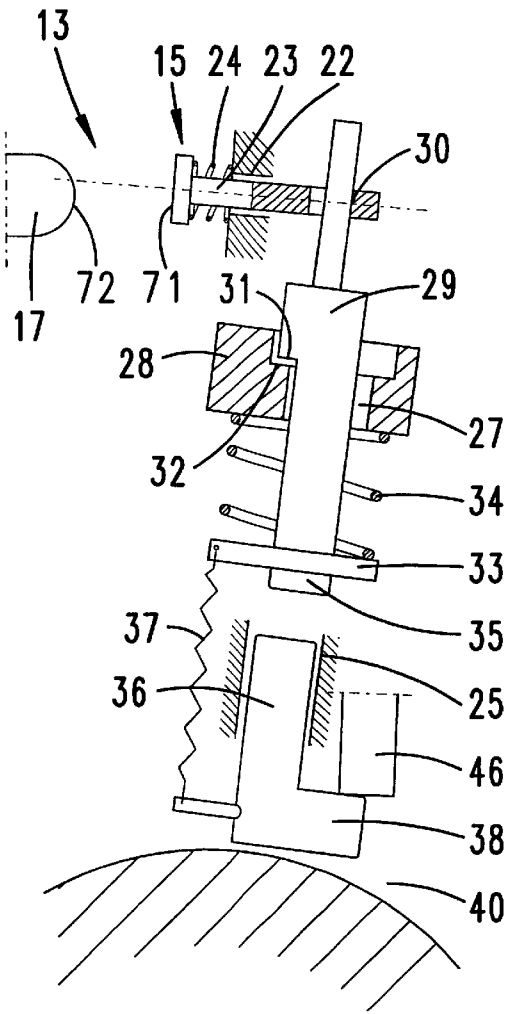
FIG. 14 shows a schematic illustration of the monitoring device in a position according to FIG. 5.
Figure 11:
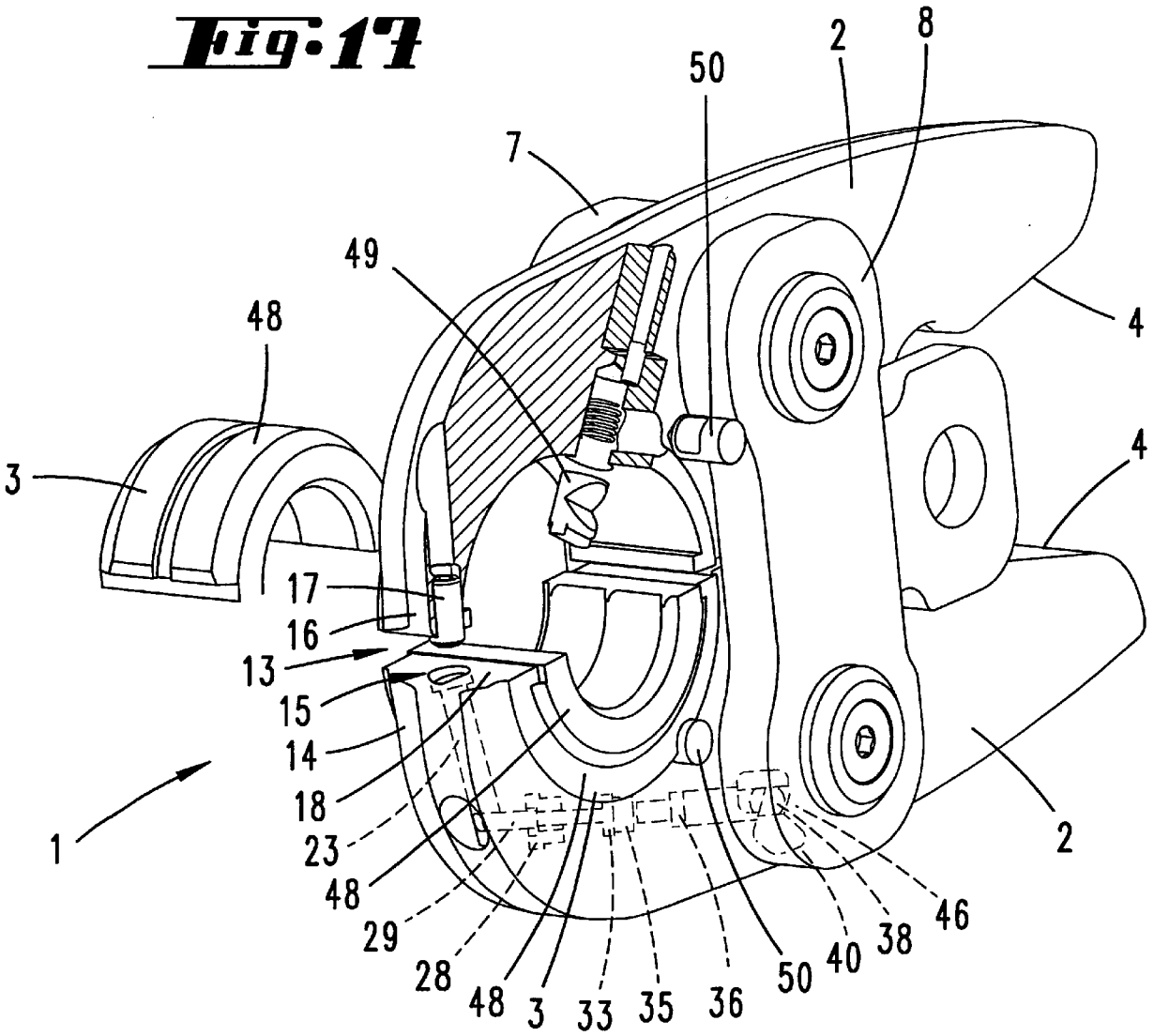

The manner of functioning of the monitoring device 13, which is also illustrated schematically in FIGS. 14 to 16, is as follows:

Starting from an open position according to FIG. 5, for the purpose of pressing a schematically illustrated blank 42, the pressing levers 2 are acted on, in the region of their cam tracks 4, via the rollers 5 such that the pressing jaws 3 are pivotally displaced towards one another. In this open position, the latching pin 29 and the blocking slide 36, which is subjected to the action thereof, are supported via the blocking pin 38, which is located in the recess 40 and here passes against a flank 43, this taking place with slight compression of the compression spring 34, which acts on the latching pin 29. The latching shoulder 31 of the thickened section of the latching pin 29, said section being guided in the release bore 30, is located, in this position, above the enlarged-diameter section of the bore 27 of the cover 28.

Figure 7:
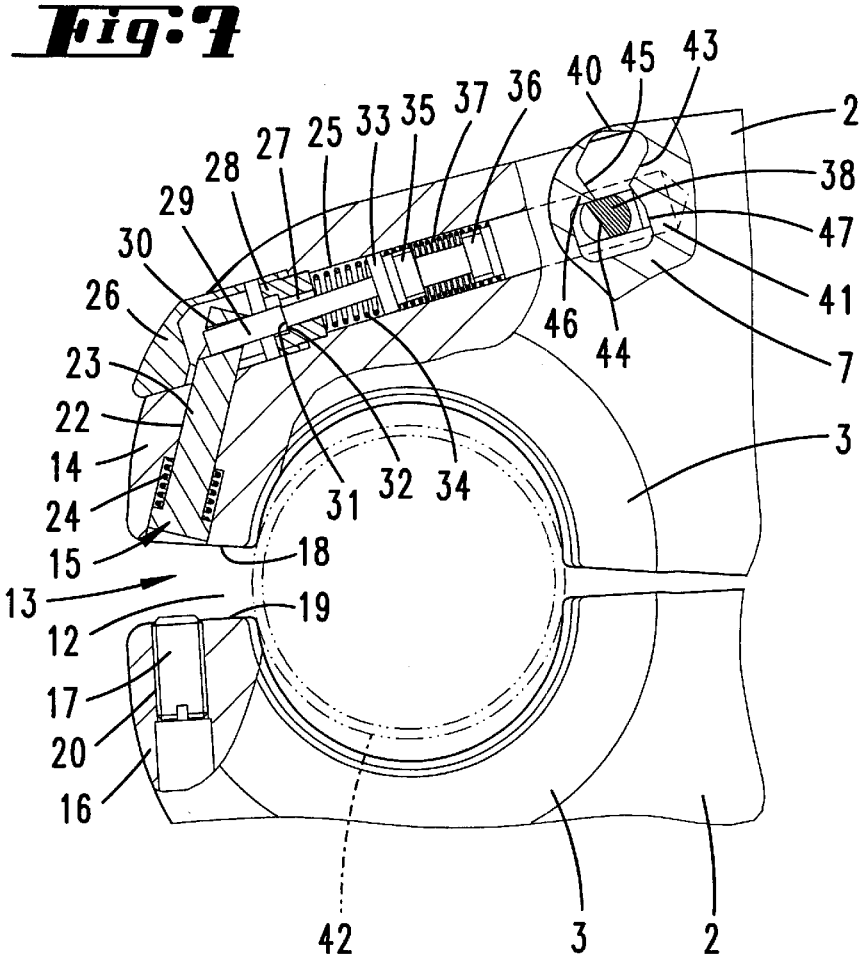
FIG. 7 shows a further follow-up illustration of the pressing levers during a closing movement.

During the pivoting displacement of the pressing levers 2 according to FIGS. 6 and 7, the blocking pin 38, on account of its displacement relative to the connecting link plate 7, moves in the recess 40 along a circle-section line running coaxially with the axis of rotation of the pressing lever 2, the action of the control edge 44 of the blocking pin 38 running on a control slope 45 of the recess 40 bringing about a displacement of the blocking slide 36 counter to the biassing by the tension spring 37, this taking place with simultaneous, spring-assisted displacement of the latching pin 29 into a latching position according to FIG. 6.

In this latching position, the latching shoulder 31 of the latching pin 29 is supported on the latching step 32 of the bore 27. This is because the bore 27 in the cover 28 and the release bore 30 of the release pin 23 are not aligned on an axis and thus the latching pin 29 extends through the cover bore 27 in a state in which it is inclined slightly in relation to the axis of the overall accommodating bore 25.

Upon further pivoting displacement of the pressing levers 2, the blocking pin 38, on account of its tension-spring loading, passes with blocking action behind a blocking projecting portion 46 of the cutout 39, said projecting portion being formed following the control slope 45 (cf. FIG. 7). Dropping of the blocking pin 38 into said blocking position is effected in that, as it runs over the control slope 45, the blocking slide 36 is raised off, counter to the biassing of the tension spring 37, from the activating mandrel 35 of the latching pin 29, which is supported on the latching step 32, and, once it has run over the control slope 45, said blocking slide 36, on account of the tension-spring loading, drops again into the position in which it is supported on the activating mandrel 35.

Figure 9:
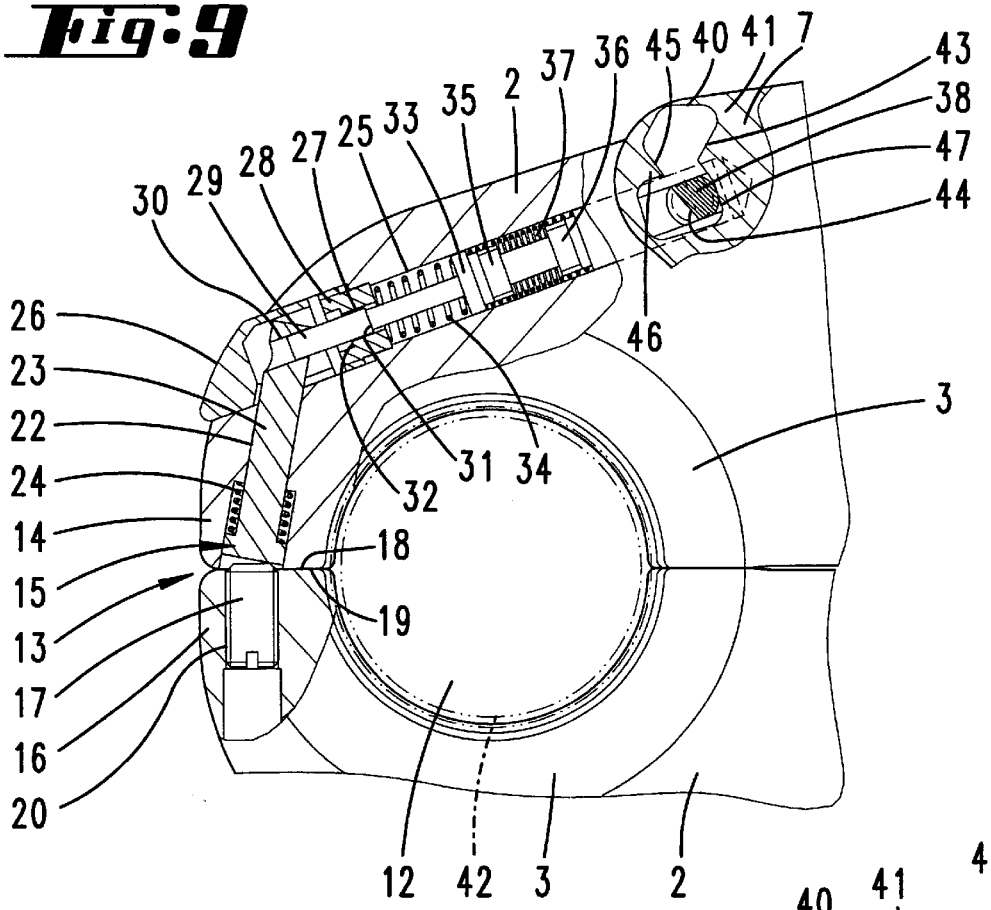
FIG. 9 shows the closed position of the pressing levers.

If the pressing levers 2 are displaced into the fully closed position of the pressing jaws 3 according to FIG. 9, then the stop 17 in the upper, free mouth end 16 of the other pressing lever 2 acts on the release pin 23, which forms a sensor 15, in that the head section of the stop 17, said head section projecting beyond the end surface 19, penetrates into the bore 22, which guides the release pin 23, and displaces the release pin 23 here counter to the biassing by the compression spring 24.

This displacement of the release pin 23 results in the latching pin 29, which is guided in the release bore 30, being carried along into a position in which it is coaxial with the cover bore 27. As a result of this, the latching shoulder 31 of the latching pin 29 leaves the latching step 32 in the cover 28, which in turn, on account of the biassing by the compression spring 34, gives rise to a linear displacement of the latching pin 29 in the cover bore 27. The smaller-diameter section of the bore 27 is matched to the external diameter of the thickened region of the latching pin 29, and is preferably enlarged slightly in relation to the same.

Figure 10:
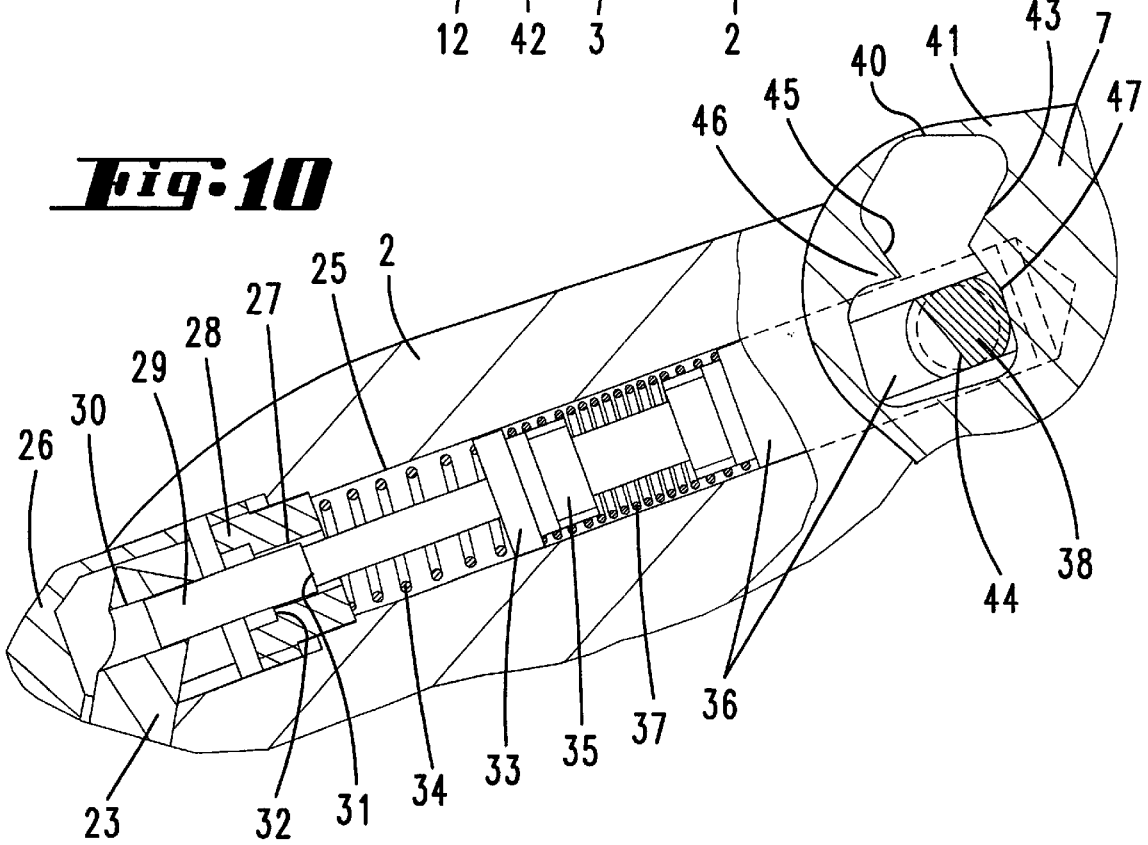
FIG. 10 shows the enlargement of the monitoring device according to the position in FIG. 9, in which a blocking pin has been displaced into the release position.

Via the activating mandrel 35, at the same time, the blocking slide 36 is carried along into a release position of the blocking pin 38 (cf. FIGS. 9 and 10). An end position is provided by the blocking pin 38 striking against a further, rear flank 47 of the recess 40.

Figure 11:
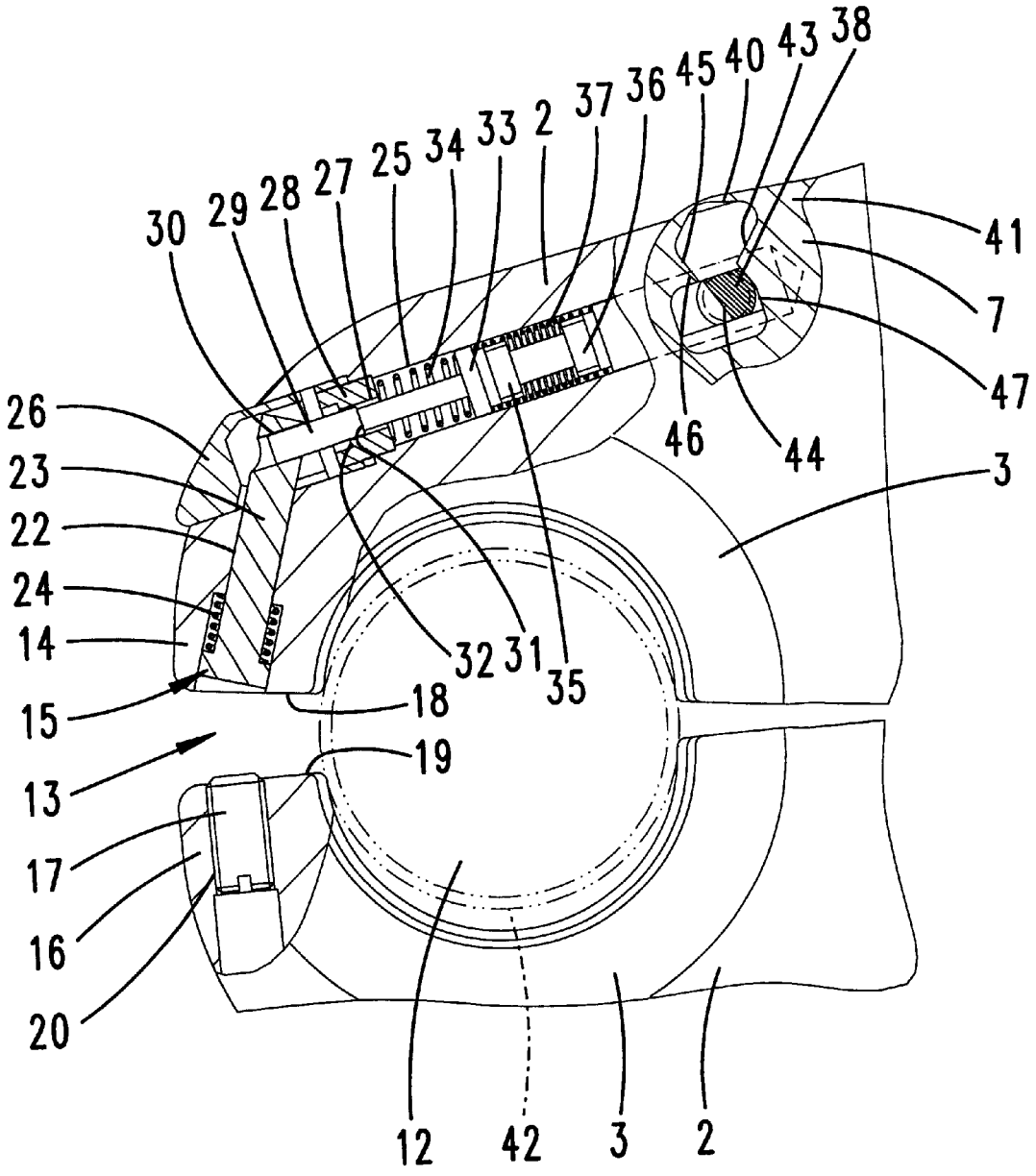
FIG. 11 shows an intermediate position of the pressing levers during an opening movement of the same following completion of closure according to FIG. 9.
Figure 13:
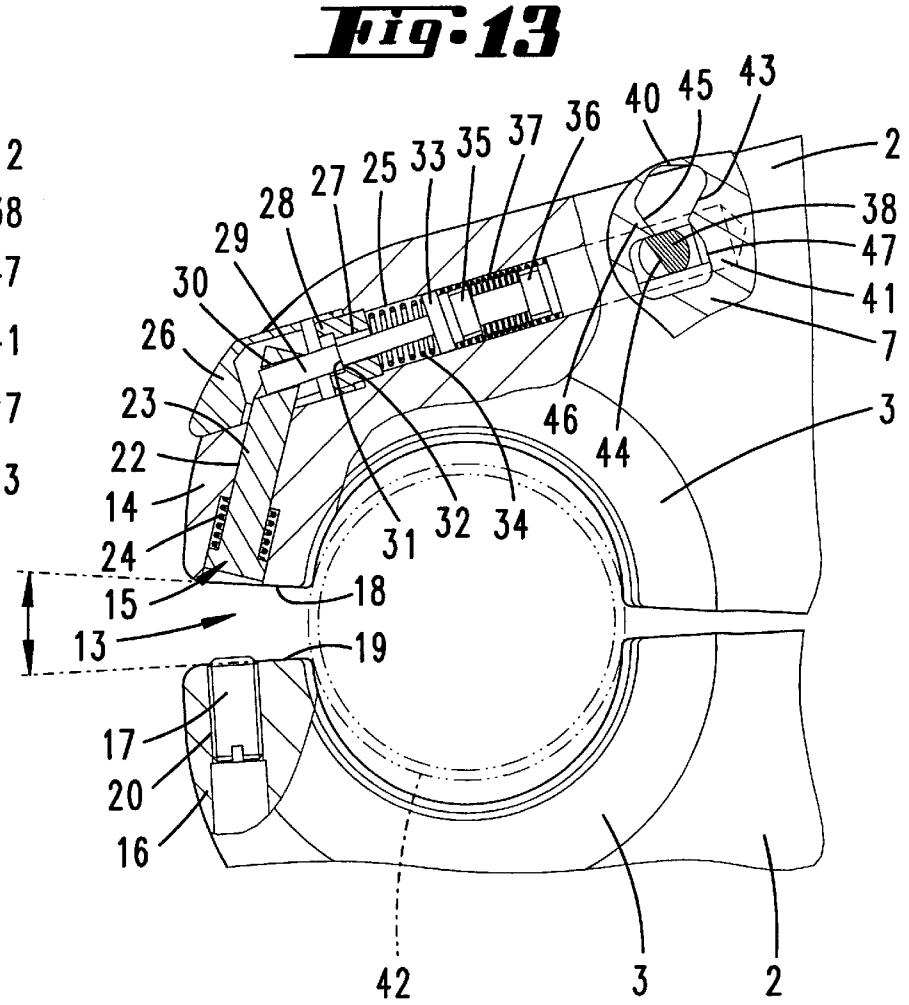
FIG. 13 shows the position blocked in the opening direction of the pressing levers by a blocking pin when an attempt is made to open the pressing levers from the position according to FIG. 12.

As a result of this release, which only takes place in he fully closed position of the pressing jaws 3, the locking pin 38 is displaced into a release position, which makes it possible, following a thus verified full pressing action of the blank 42, for the pressing levers 2 to be pivoted back again into the fully open position according to FIG. 5. In the case of such a pivoting displacement of the pressing levers 2, the blocking pin 38 moves again over a circular arc within the recess 40, while running beneath the blocking projecting portion 46 (cf. FIG. 11). Once the open position has been achieved, the pressing tool 1 can be withdrawn from the blank 42.

Figure 12:
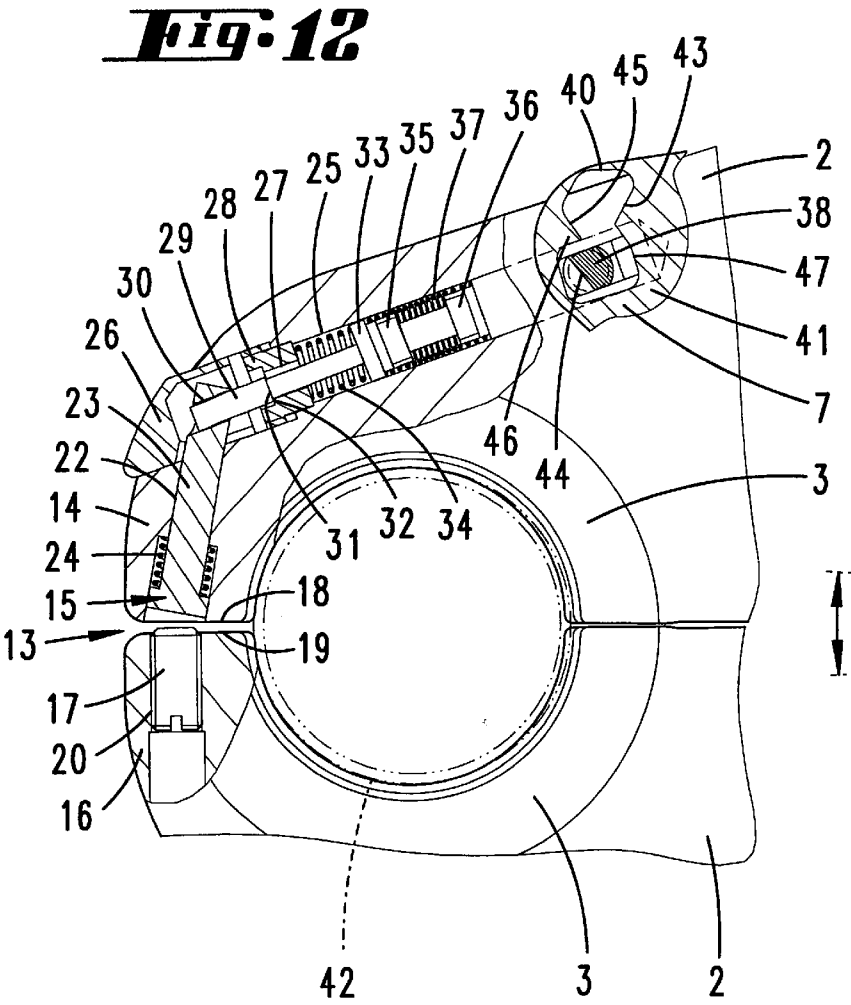
FIG. 12 shows a partially sectioned illustration in detail form according to FIG. 9, but with the pressing mouth not fully closed.

If, in contrast, as illustrated in FIG. 12, there is an incomplete pressing action of the blank 42, then the release pin 23 is not subjected to the action of the stop 17. As a result of this, the latching pin 29 remains in its latched position in the cover 28 or the bore 27 thereof. Furthermore, as a result of this, the blocking pin 38 remains in its blocking position, in which it engages behind the blocking projecting portion 46. If an attempt is made to open the pressing jaws 3 and/or pressing levers 2, the blocking pin 38 moves against the blocking projecting portion 46, which prevents any further pivoting displacement of the pressing levers 2 into the open position. The pressing levers 2 preferably remain here in a partially open position with an opening angle alpha of approximately 10°. As a result of the blocking, the pressing tool 1 cannot be withdrawn from the blank 42. This can only take place following a full pressing action and associated release of the blocking.

Since the stop 17 projects beyond the end surface 19 of the-mouth end 16, which receives the stop 17, and the activating surface (sensor tip 71) of the release pin 23 is set back in relation to the end surface 18, incorrect release, for example by striking against objects, is ruled out. Release for the disengagement of the pressing levers 2 is only made possible following full closure of the pressing jaws 3 and associated full pressing action on a blank 42.

By this configuration, it is also ensured that it is possible to detect any possible rupturing of the pressing levers 2 in the front, pressing-jaw region since, in this case, there is no contact between the free mouth ends 14, 16 and/or the end surfaces 18, 19 thereof.

The monitoring device 13 according to the invention can be used not just in the case of straightforward pressing jaws with fixed geometry, but also in the case of closing jaws for closing-chain pressing tools and pressing jaws for exchangeable inserts.

Figure 18:
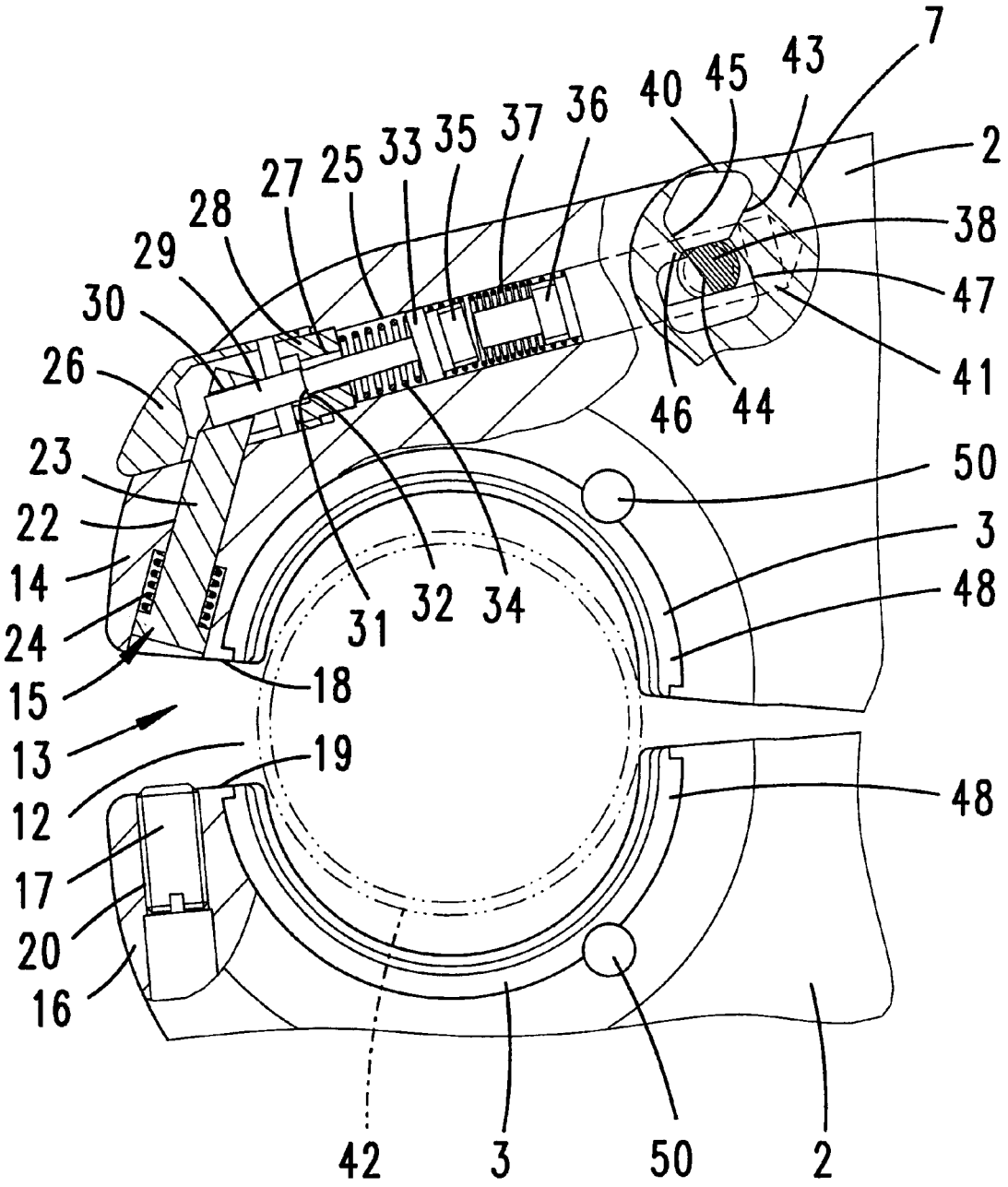
FIG. 18 shows an illustration corresponding to FIG. 6 but in relation to the embodiment according to FIG. 17.

An exemplary configuration of a pressing tool with exchangeable inserts 48 is illustrated in FIGS. 17 and 18. Said inserts are retained on the pressing levers 2 by spring-assisted latching elements 49, and said latching can be released in a known manner by means of release pins 50. A monitoring device 13 which acts, and is formed, in accordance with the first exemplary embodiment is also provided here.

Figure 19:
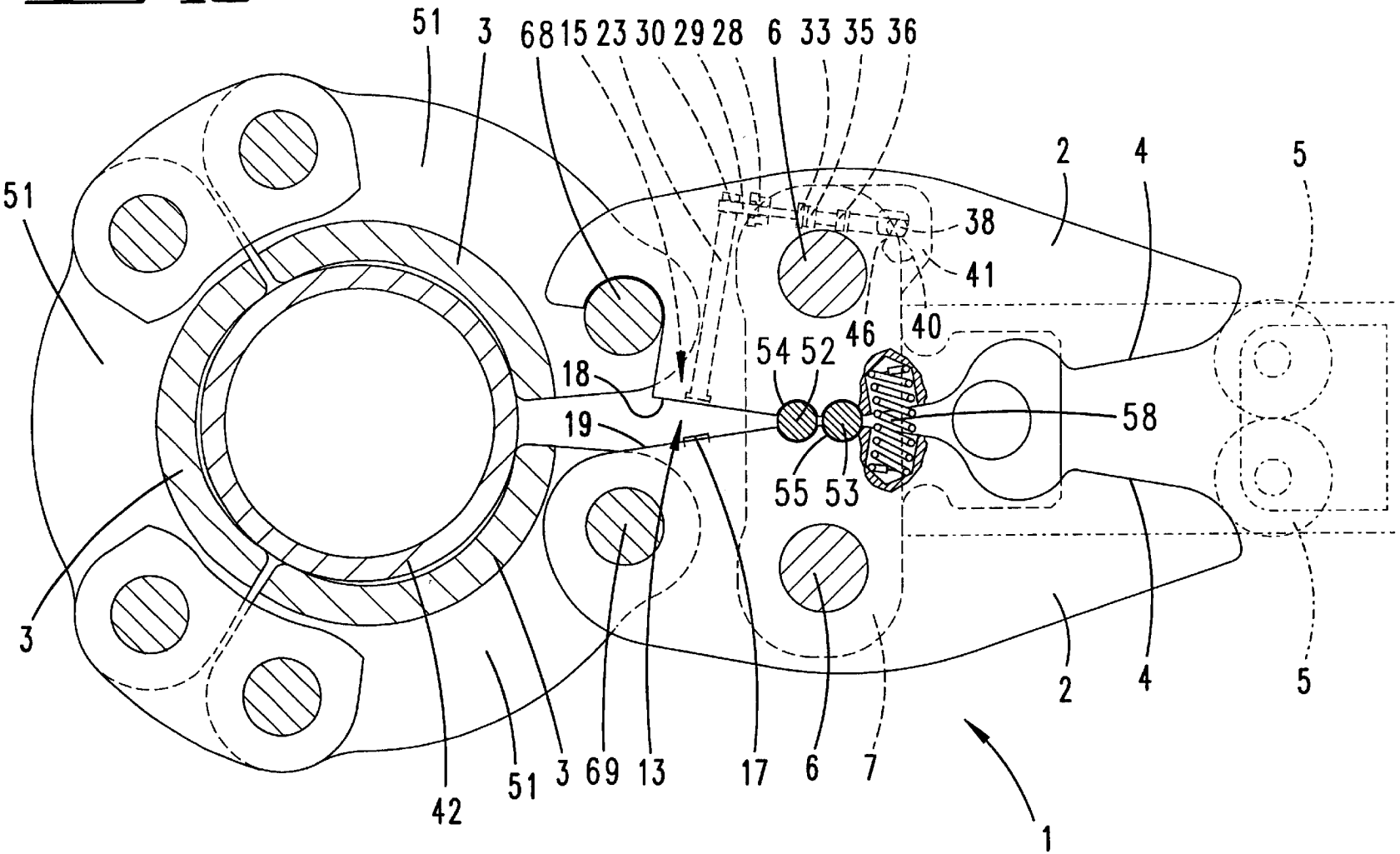
FIG. 19 shows a further embodiment of- the pressing tool as a closing-chain pressing tool.
Figure 20:
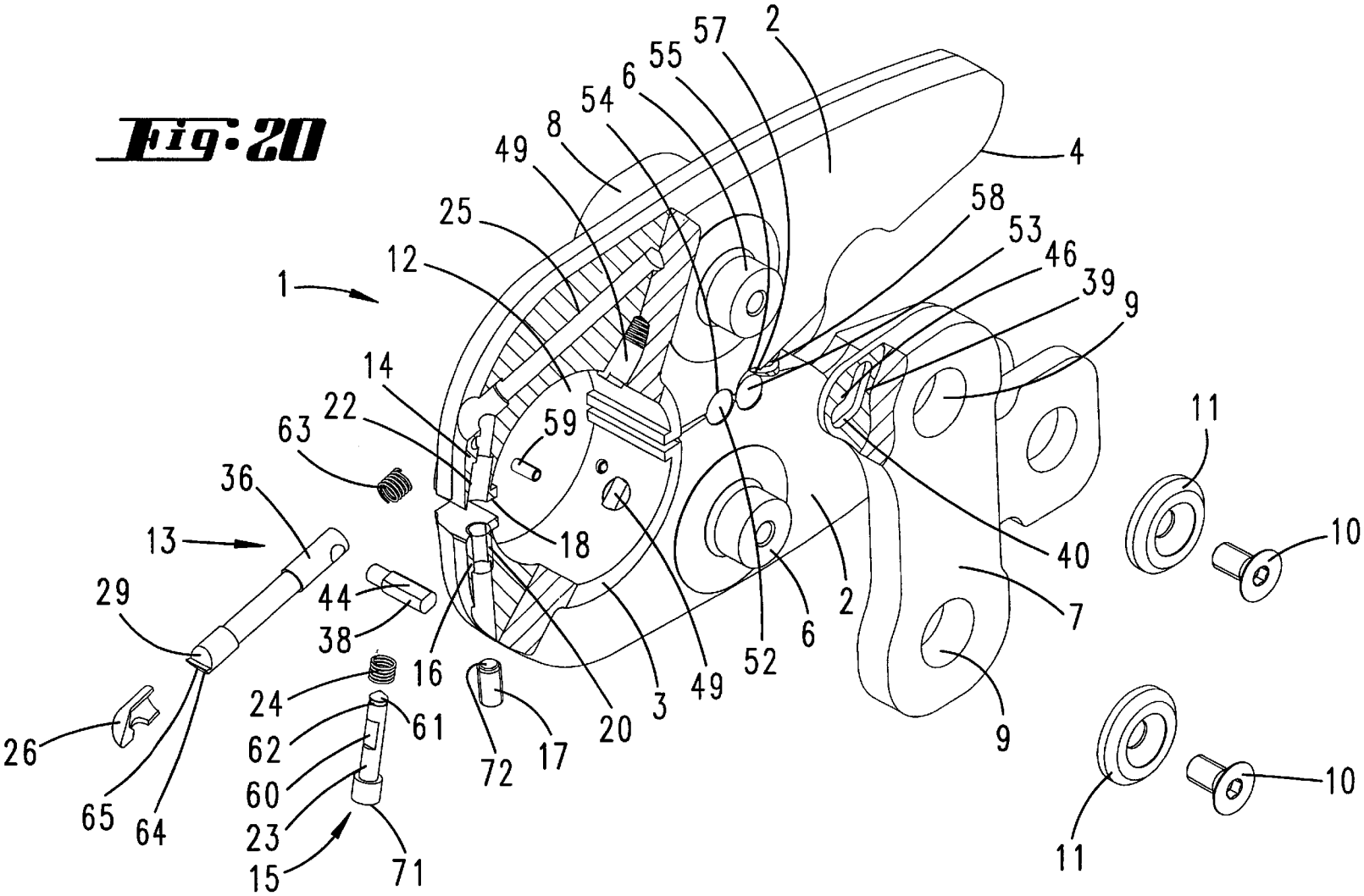
FIG. 20 shows a perspective exploded illustration of the pressing tool in a further embodiment, said illustration corresponding to FIG. 4.

An exemplary configuration of a closing-chain pressing tool with a monitoring device 13 according to the invention is illustrated in FIG. 19. As far as the operation is concerned, reference is directed to DE-A1 198 03 536. The content of this patent application is hereby also incorporated in full in the disclosure of the present invention, also for the purpose of including features of this patent application in claims of the present invention.

In this case, two pressing levers 2 close pressing-chain links 51 for the purpose of pressing a blank 42. This closing position is monitored by means of a monitoring device 13 in the same way as the abovedescribed exemplary embodiments, there also being provided in this case, on one pressing lever 2, a stop 17 which displaces a release pin 23 in the closed position, whereupon a latching pin 29 passes out of a latching position into a release position of the blocking pin 38, which is subjected to the action of said latching pin. During the pivoting displacement of the pressing levers 2, the blocking pin moves within a recess 40 which is formed in a connecting link plate 7 and is likewise provided with a blocking projecting portion 46. The manner of operation of the monitoring device 13 is the same as that for the first exemplary embodiment.

A further exemplary configuration of a pressing tool—in this case with exchangeable inserts 48—is illustrated in FIGS. 20 to 25. Here too, according to the invention, the closing position of the pressing jaws 3 and/or of the pressing levers 2 is monitored by means of a monitoring device 13, for which purpose one pressing lever 2 has a sensor 15 in the region of the upper, free mouth end 14 of the pressing jaw 3 and the other pressing lever 2 has an adjustable stop 17 in the region of its upper, free mouth end 16, it being possible for said stop to be associated with said sensor.

In this exemplary embodiment, the sensor 15 is also formed as a mechanically acting release pin 23, the end thereof which is directed towards the end surface 18 and that end of the stop 17 which interacts therewith projecting beyond the respective end surface 18, 19.

The release pin 23 is guided in a bore 22 which is open in the direction of the end surface 18 of the one pressing lever 2, and it is biassed by means of a compression spring 24 in the direction of the end surface 18, i.e. into the sensor position. The displaceability of the release pin 23 is limited by a stop pin 59 which is disposed transversely to the bore 22 and engages in a correspondingly positioned recess 60 on the outer surface of the release pin 23. Said recess 60 is in the form of a flattened portion of the otherwise cross-sectionally circular release pin 23.

The free end of the release pin 23, said end being directed away from the end surface 18, projects into the bore 25, which receives the blocking slide 36, and forms here, by a pointed formation, a run-on slope 61 which interacts with the latching pin 29. Provided to the rear of this run-on slope 61 is a latching recess 62 formed by an annular groove.

In the region of its end which is directed away from the release pin 23, the blocking slide 36, which is guided in the bore 25, carries a blocking pin 38 which is aligned transversely to the alignment of the blocking slide 36 and, passing through a cutout which is open in the direction of a surface of the pressing lever 2, engages in a recess 40 of the connecting link plate 7. This recess 40 is also formed on the side which is directed towards the pressing lever 2, and according to the sectional illustrations shown it has a substantially L-shaped-link-like contour.

The blocking slide 36, which carries the blocking pin 38, is biassed in the direction of the release pin 23 by means of a compression spring 63.

In this exemplary embodiment, the latching pin 29, which interacts with the release pin 23 during the monitoring, is formed in one piece with the blocking slide 36 and, at its free end has a latching nose 64 which interacts with the latching recess 62 of the release pin 23 and the end surface 65 of which is formed to be bevelled in accordance with the run-on slope 61 of the release pin 23.

By the engagement of the blocking pin 38 in the recess 40 of the connecting link plate 7, the latching pin 29 is secured against rotation, with the result that the arrangement provided is always one which secures the action of the run-on slopes 65 and 61 in relation to one another and the interaction of the latching nose 64 and latching recess 62.

Figure 21:
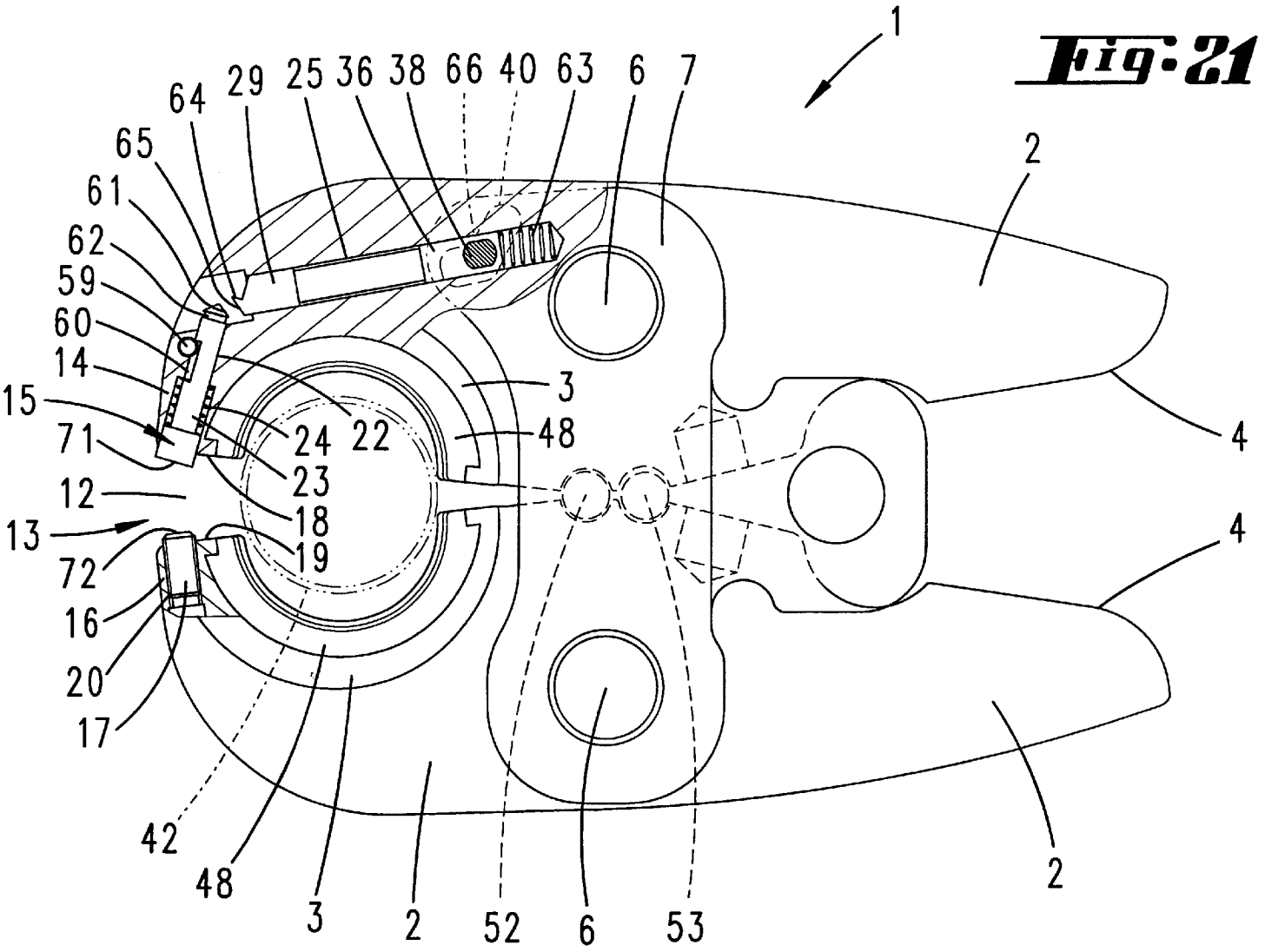
FIG. 21 shows the pressing tool according to FIG. 20 in a partially sectioned view, with the monitoring device in an unblocked position.

The monitoring device 13 which is illustrated in FIGS. 20 to 25 operates as follows:

Starting from an open position according to FIG. 21, for the purpose of pressing a schematically illustrated blank 42, the pressing levers 2 are activated, in the region of their cam tracks 4, via rollers 5 (not illustrated) such that the pressing jaws 3 and/or the inserts 48 are pivotally displaced towards one another.

In this open position, the blocking pin 38 is located in a section of the recess 40 which is aligned substantially concentrically with the axis of rotation of the pressing lever 2, this taking place with compression of the compression spring 63, which acts on the blocking slide 36. The latching pin 29 and/or the sloping end surface 65 thereof, which is provided with the latching nose 64, is spaced apart, in this position, from the run-on slope 61 of the release pin 23. As the pressing levers 2 are pivotally displaced into the closed or pressing position, the blocking pin 38, on account of its displacement relative to the connecting link plate 7, moves along a circle-section line, running coaxially with the axis of rotation of the pressing lever 2, in the recess 40 until it passes into that section of the recess 40 which is angled in an L-shaped manner and runs parallel to the direction of extent of the blocking slide 36, which results in the blocking slide 36 being displaced, by the action of the a compression spring 63, in the direction of the release pin 23. This displacement of the blocking slide 36 is stop-limited by the sloping end surface 65 of the latching nose 64 on the latching pin being supported on the run-on slope 61 of the release pin 23 (cf. FIG. 23).

Figure 23:
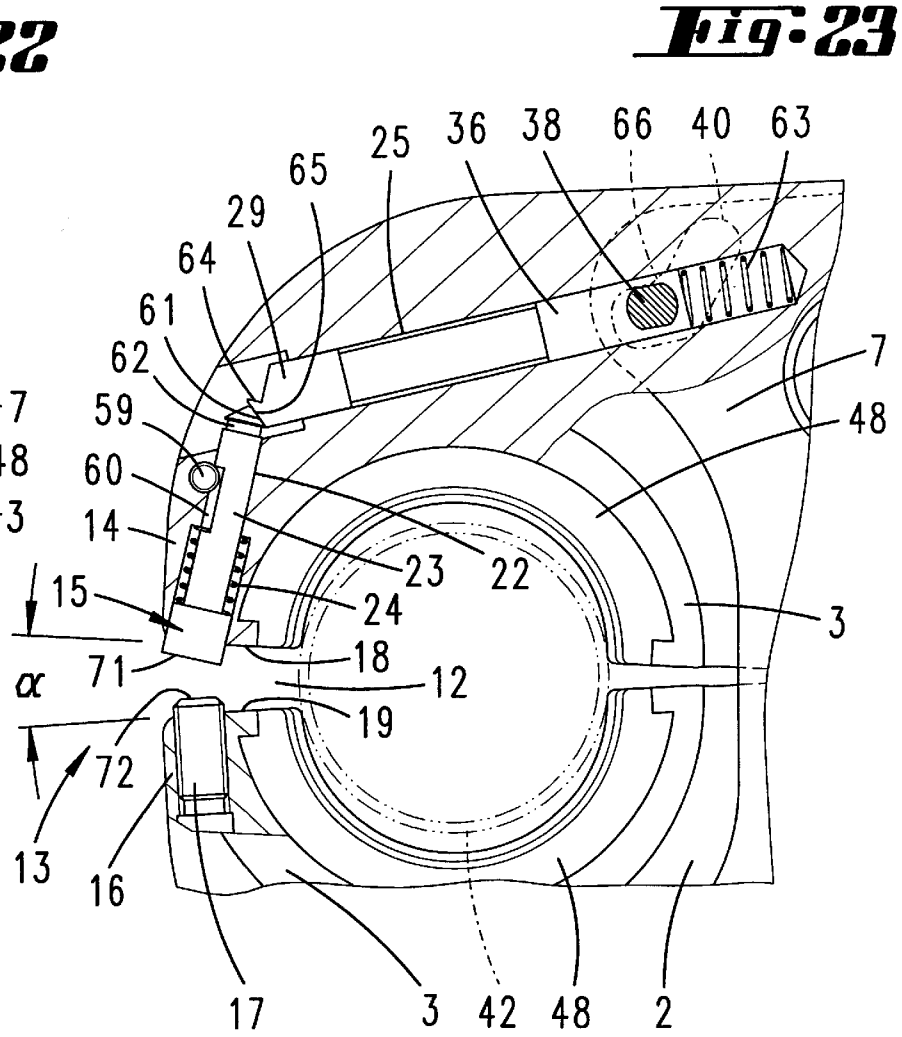
FIG. 23 shows the monitoring device illustrated in the blocking position.
Figure 22:
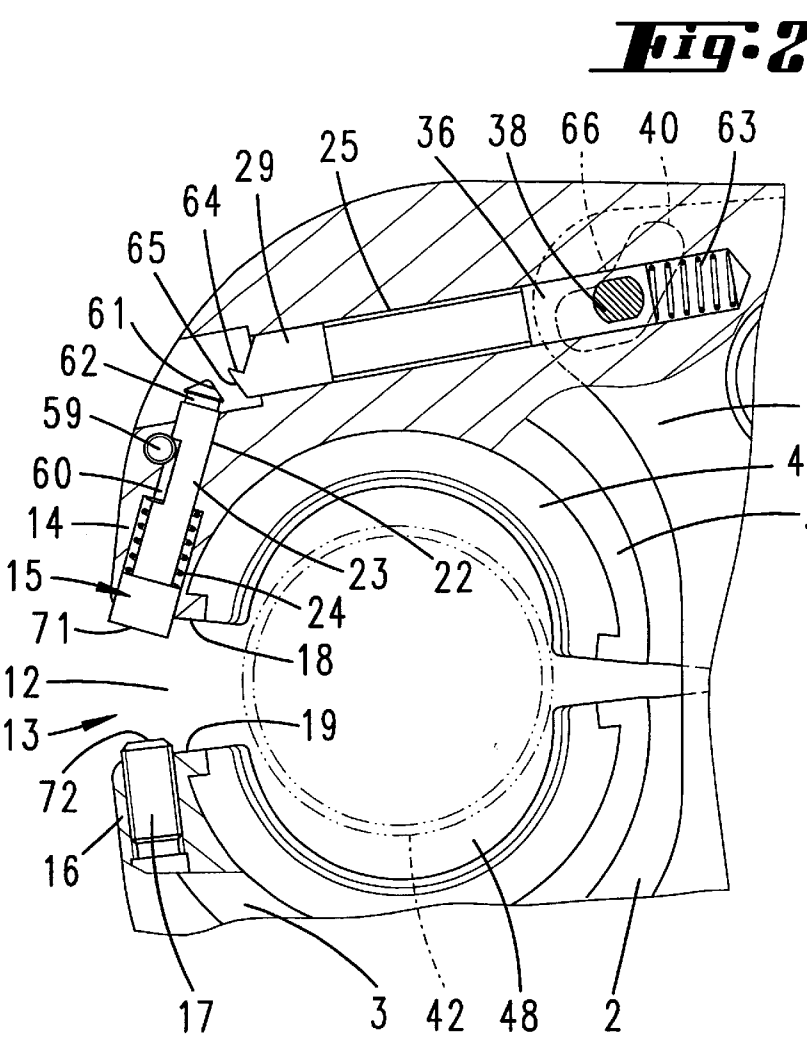
FIG. 22 shows an illustration in detail form of the pressing levers held in the open position.
Figure 25:
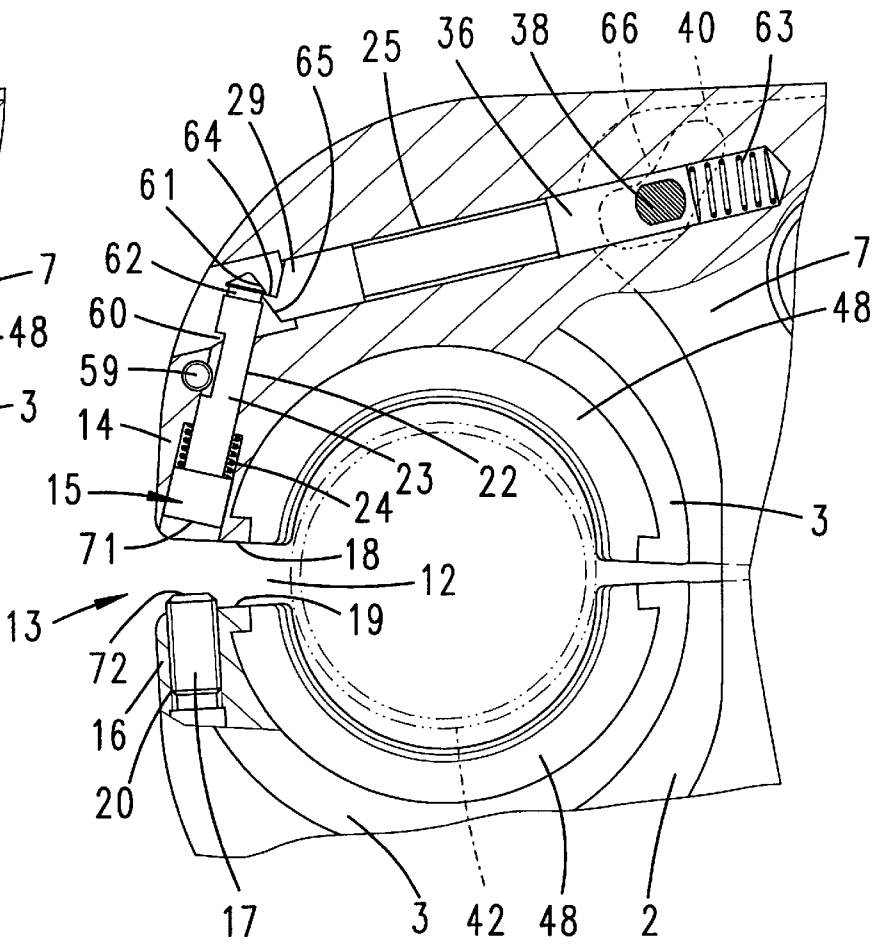
FIG. 25 shows an intermediate position of the pressing levers during an opening movement of the same following completion of closure according to FIG. 24.

It is no longer possible for the pressing tool 1 to be opened from this position. If an attempt is made to displace the pressing levers 2 back into the open position, said pressing levers remain in the partially open position which is illustrated in FIG. 23 and in which they have an opening angle alpha of approximately 10°, since the blocking pin 38, which is supported on the blocking projecting portion 46, which is formed in that section of the recess 40 which runs parallel to the blocking slide 36, prevents any further rotary displacement.

Figure 24:
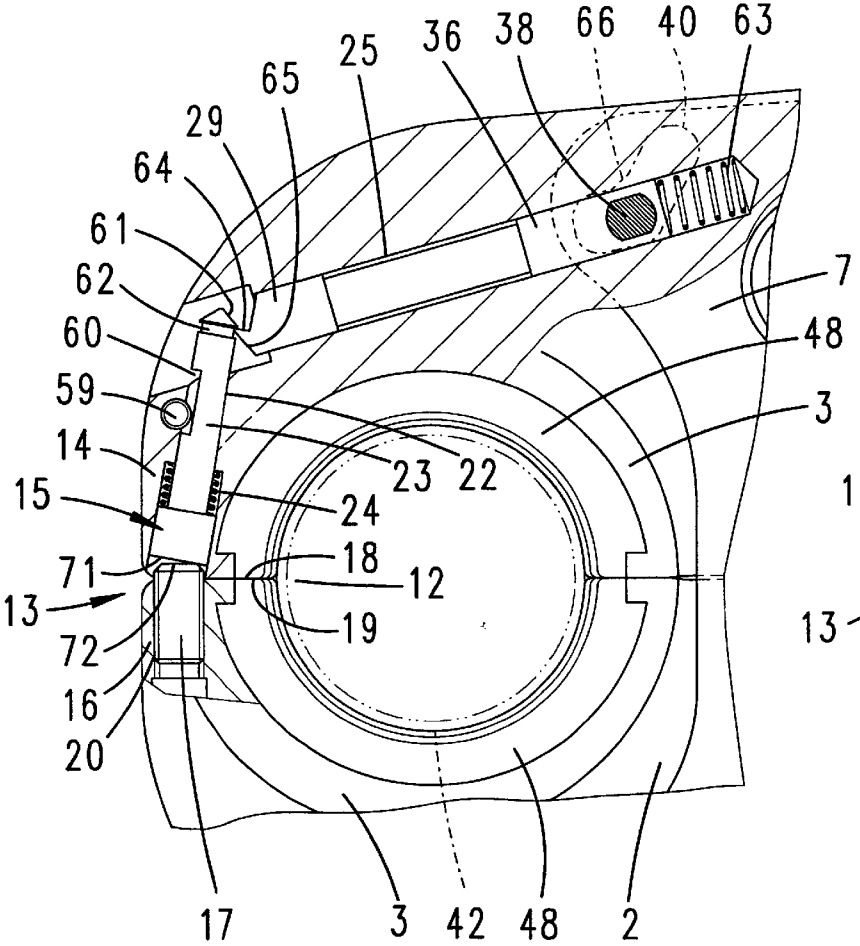
FIG. 24 shows the closed position of the pressing levers.

If the pressing levers 2 have been displaced into the fully closed position of the pressing jaws 3 and/or of the inserts 48 according to FIG. 24, then the release pin 23 is displaced, counter to the force of the compression spring 24 acting on it, by the stop 17, which acts on the release pin 23. During this linear displacement of the release pin 23, the sloping end surface 65 of the latching part 29 runs along the run-on slope 61, which causes reverse displacement of the blocking slide 36 counter to the force of the compression spring 63. Once it has run along the run-on slope 61, the latching nose 64 of the latching part 29, spring-assisted by the compression spring 63, drops into the groove-like latching recess 62 of the release pin 23. As a result of this, by a self-retaining action, the position of the release pin 23 and blocking slide 36 which is illustrated in FIG. 24 is secured.

This secured position is only achieved in the fully closed position of the pressing jaws 3. By virtue of the reverse displacement of the blocking slide 36, the blocking pin 38, which is disposed on the blocking slide 36, is displaced into the region of that section of the recess 40 which is aligned substantially coaxially with the axis of rotation of the pressing lever 2, whereby the pressing levers 2 can move again, from this position, fully into their open position according to FIG. 21.

During this pivoting-open movement of the pressing levers 2, the blocking pin 38, which can be displaced in the recess 40, moves against a control surface 66, as a result of which a further reverse displacement of the blocking slide 36, and thus the latching pin 29, is effected, with the result that the latching nose 64 of the latching pin 29 leaves the latching recess 26 of the release pin 23. Thereafter, the latter is displaced automatically back into the sensor position according to FIG. 21 by the force of the compression spring 24.

It is also the case in this exemplary embodiment that the locking mechanism between the pivotable part (pressing lever 2) and the part which is rotationally fixed in relation to the same (recess 40) is covered towards the outside by the connecting link plate 7. Because of the location of said locking mechanism in the vicinity of the fulcrum, it is subjected to only relatively small lever forces.

Figure 26:
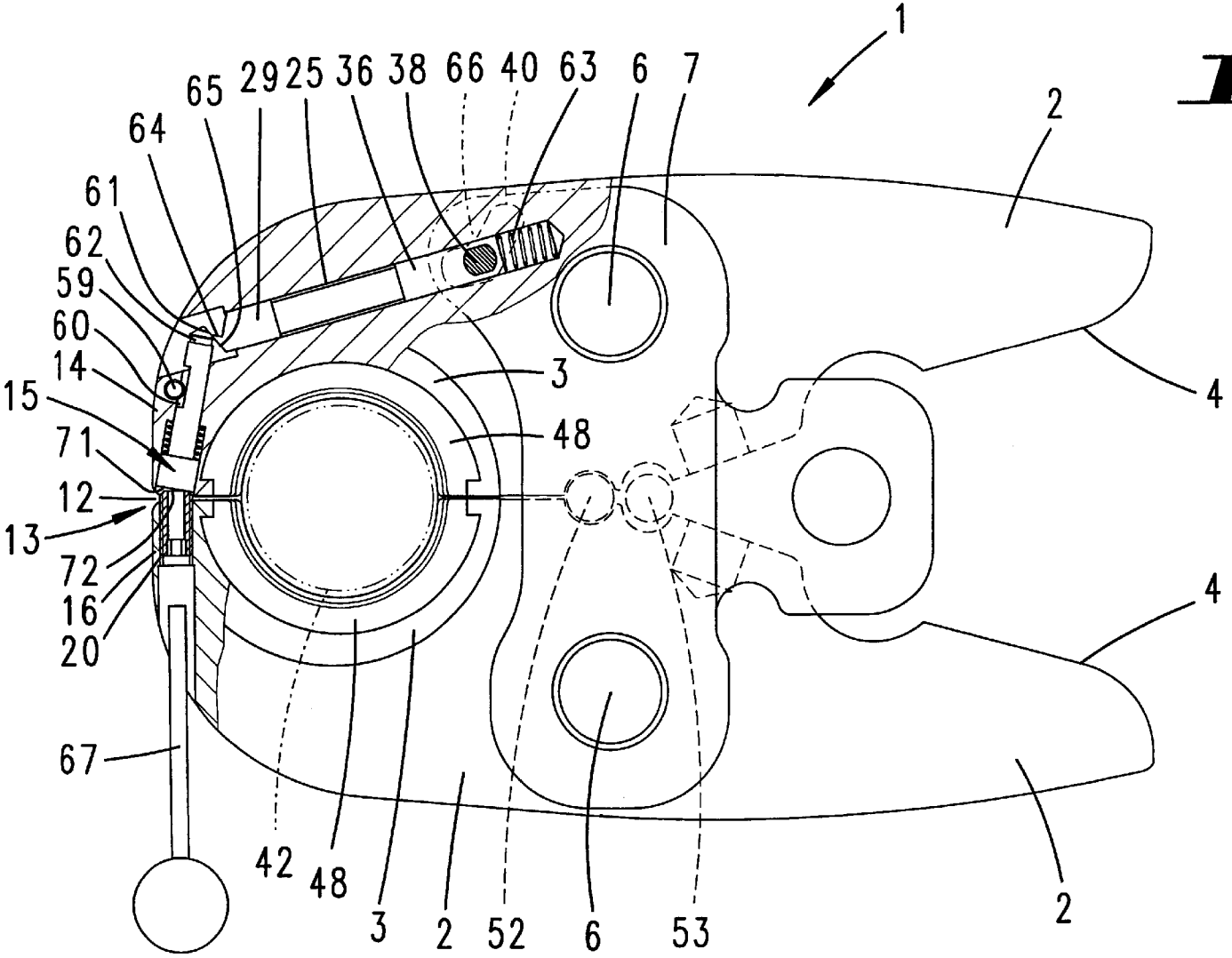
FIG. 26 shows a partially sectioned view illustration of a pressing tool according to the invention with the pressing mouth not fully closed, in a further embodiment having a handle for emergency unlocking purposes.

As can be seen in the further exemplary embodiment according to FIG. 26, it is also possible to provide emergency unlocking which allows, the pressing tool 1 to be opened, i.e. the pressing levers 2 to be pivoted into the open position even following an incomplete pressing action. Provided, for this purpose, in the exemplary embodiment illustrated is a separate handle 67 which may be, for example, in the form of a screwdriver or of a hexagon spanner. By means of this handle 67, the stop 17 can be acted on in the rearward direction for the purpose of displacing the same in the direction of the release pin 23, thus preferably displacing it by screwing action in the direction of the release pin 23.

As a result of this measure, it is possible to bridge the gap remaining between the end surfaces 18 and 19 for the purpose of activating the release pin 23, this activation of the release pin 23 causing displacement of the blocking slide 36, and thus the blocking pin 38, into the release position.

Figure 27:
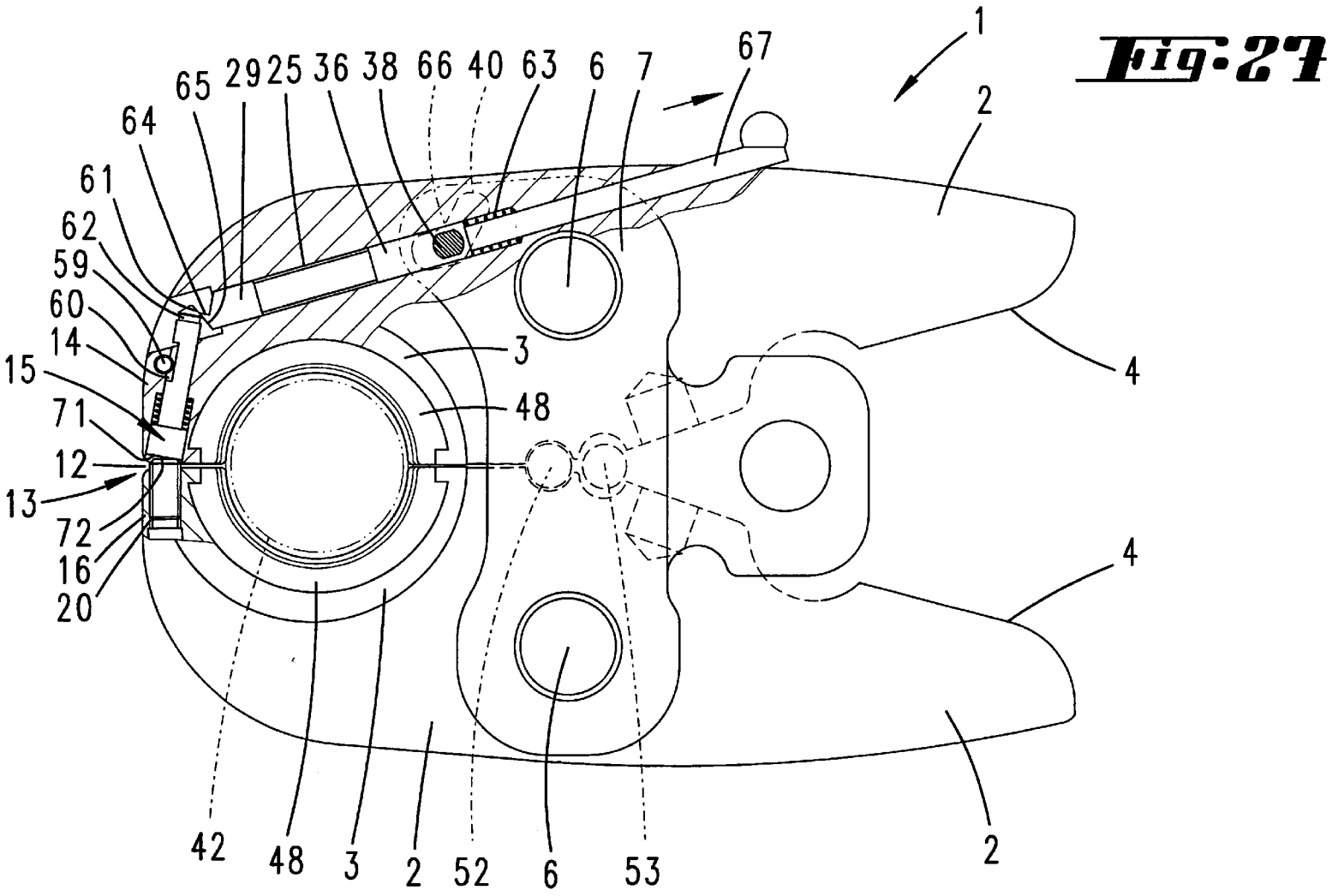
FIG. 27 shows an illustration corresponding to FIG. 26 but illustrating a further embodiment of the pressing tool with emergency unlocking.
Figure 28:
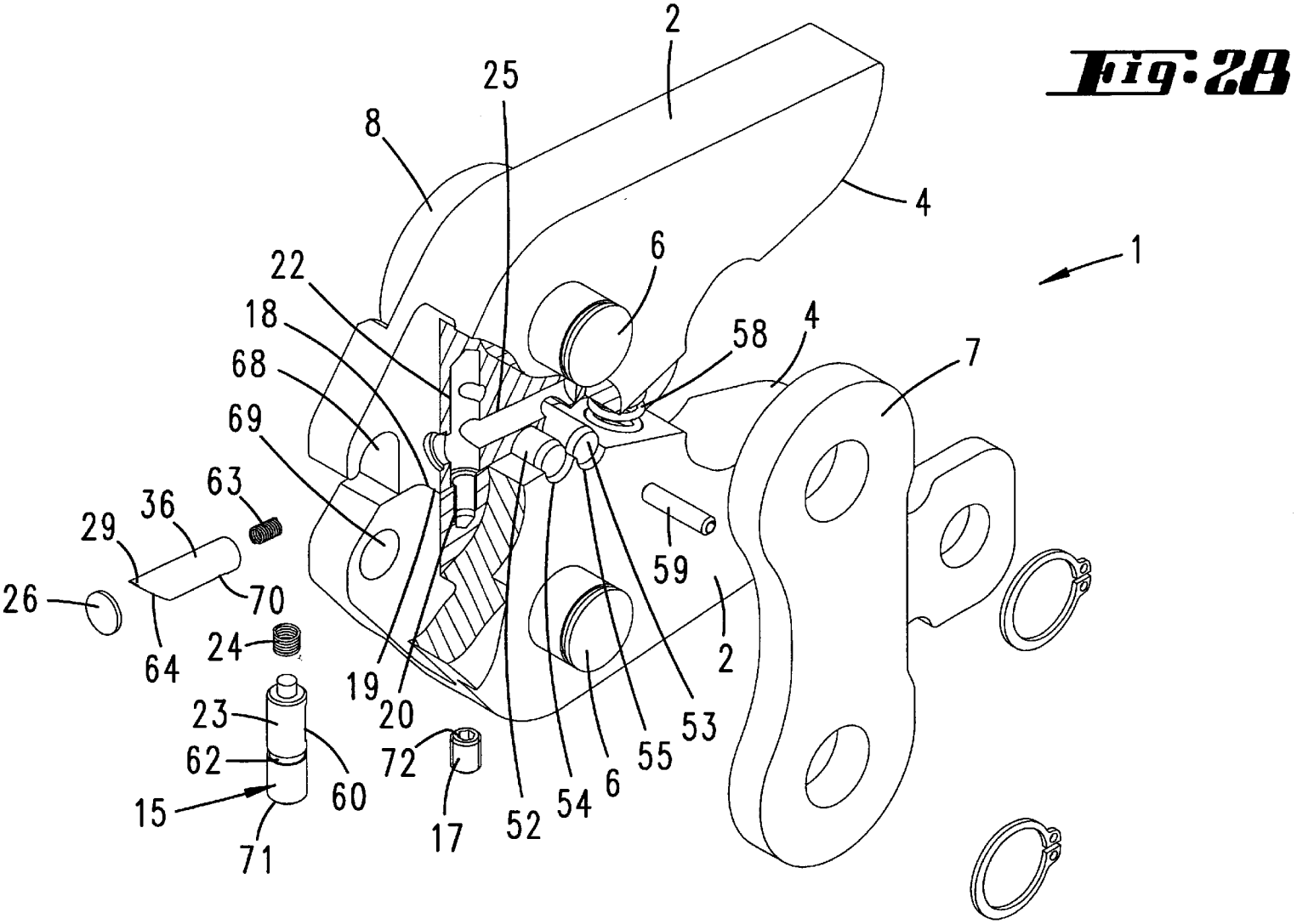
FIG. 28 shows a further perspective exploded illustration corresponding to FIG. 4 but in relation to a further embodiment of a pressing tool.
Figure 29:
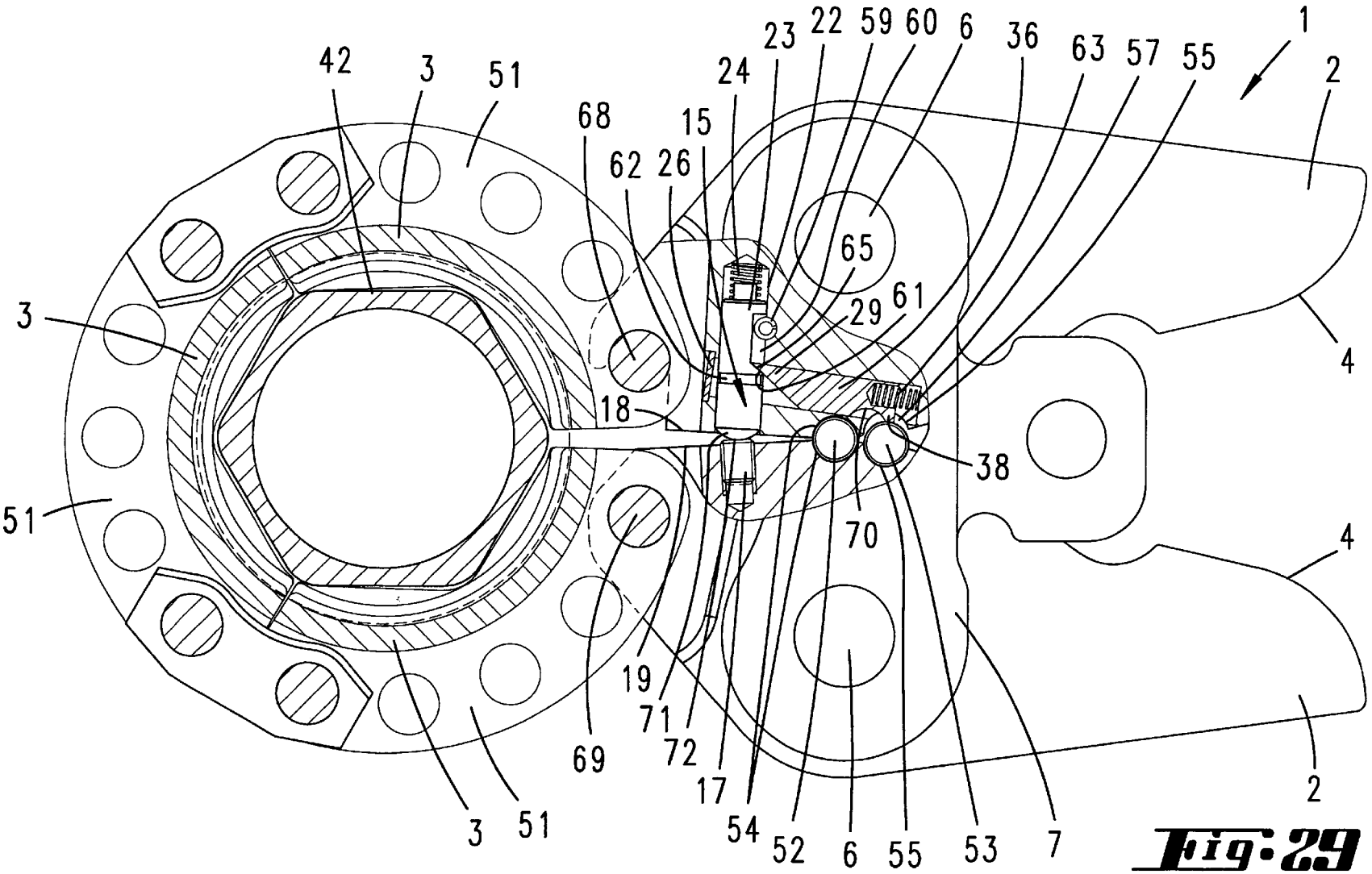
FIG. 29 shows a partially sectioned view illustration of the pressing tool according to FIG. 28 with associated closing chain.
Figure 31:
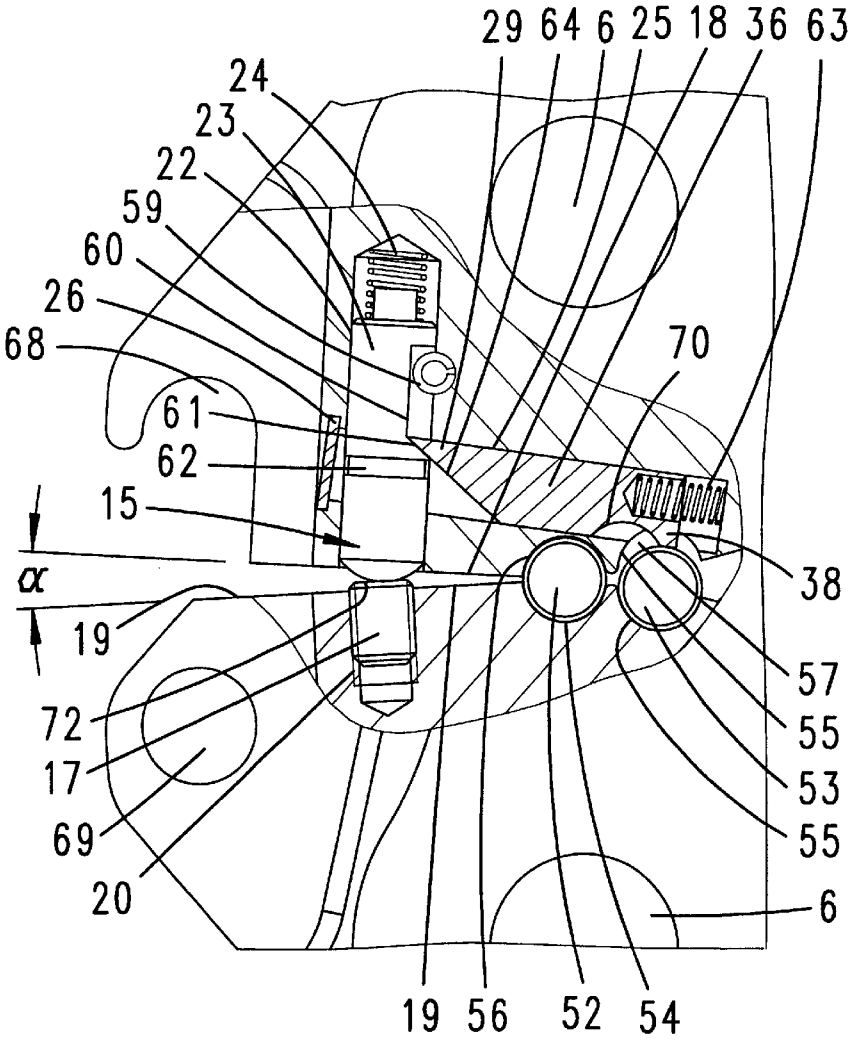
FIG. 31 shows a follow-up illustration to FIG. 30 illustrating an intermediate position during a closing movement of the pressing levers and the blocking catch activated.

An alternative configuration of emergency unlocking of this kind is illustrated in FIG. 27. Provided in this case is a handle 67 which is associated with the pressing tool 1, is disposed on the blocking slide 36, in extension of the same, and, at its end, projects laterally beyond the associated pressing lever 2 for the purpose of actuating the same. By means of this handle 67, for emergency unlocking purposes, the blocking slide 36, together with the blocking pin 38, can be pulled into the release position. Furthermore, the position of the blocking pin 38 can be seen by way of the freely projecting handle end, it being possible for the release or blocking position to be read off by virtue of, for example, the application of signal colours in the through-passage region of the handle and pressing lever.

A further exemplary configuration of a closing-chain pressing tool with a monitoring device 13 according to the invention is illustrated in FIGS. 28 to 33. In this case, the sensor 15 is positioned in the immediate vicinity of the points 68, 69 at which the pressing links 51 are articulated onto the pressing levers 2.

It is also the case in this exemplary embodiment that the monitoring device 13 substantially comprises a stop 17, a release pin 23 and a blocking slide 36, a locking action taking place in the region of the rolling bodies 52, 53. The locking mechanism is thus also covered towards the outside by the connecting link plate 7.

The closing position of the pressing levers 2 is monitored in the region of the mutually facing end surfaces 18, 19 of the pressing levers 2, said end surfaces being formed between the points of articulation 68, 69 and the rolling body 52, which is closer to the mouth.

It is also the case in this exemplary embodiment that the stop 17 is seated in a threaded bore 20, which opens out in the end surface 19, such that the body axis thereof is aligned approximately perpendicularly to the associated end surface 19. Furthermore, the arrangement here is also selected such that that end of the stop 17 which interacts with the sensor 15 projects beyond the end surface 19.

In the same way as the abovedescribed exemplary embodiments, the sensor 15 is formed as a release pin 23 which is guided in a bore 22, open in the direction of the end surface 18 of the one pressing lever 2, and which is biassed in the direction of the end surface 18 by means of a compression spring 24. In this exemplary embodiment, the bore 22 is formed as a blind bore, on the base of which the compression spring 24 is supported for the purpose of acting on the release pin 23 in the rearward direction. Said release pin has its displacement stop-limited in the direction of the end surface 18 by a stop pin 59 which is disposed transversely to the bore 22 and projects into a recess 60 of the otherwise cross-sectionally substantially circular release pin 23.

At its end which is directed towards the end surface 18, i.e. the sensor region, this recess 60 of the release pin 23 forms a run-on slope 61, which is adjoined by an annular groove forming a latching recess 62. Said annular groove is positioned approximately halfway along the length of the extent of the release pin 23.

The bore 22 of the release pin 23 is crossed by a further bore 25, in which a blocking slide 36 can be displaced linearly. The bore 25 in this case is positioned approximately level with the latching recess 62 in the initial position of the release pin 23 according to FIG. 30 and encloses an angle of approximately 90° with the bore 22.

The bore 25 is formed to be open in the direction of the side which is directed towards the articulation points 68, 69 of the pressing levers 2, it being possible for a cap 26 to be fitted in order to avoid contamination.

The blocking slide 36 is positioned in the bore 25 such that the release pin 23 is disposed to cross the bore 25 between the blocking slide 36 and the opening of the bore 25, which is closed by the cap 26.

Figure 30:
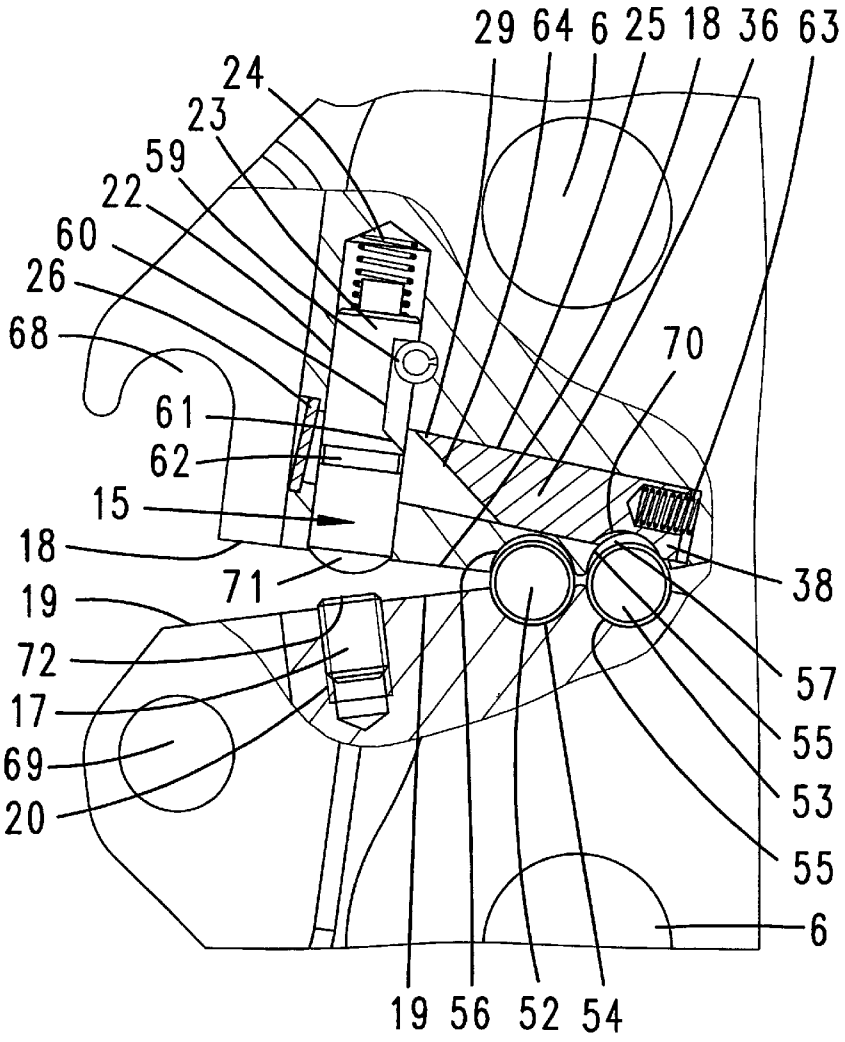
FIG. 30 shows a partially sectioned illustration in detail form of the pressing levers in the open position.

Furthermore, the blocking slide 36 is acted on in the direction of the release pin 23 by a compression spring 63, which is supported on the base of the bore 25, and, in the region which is directed towards the rolling body 53, remote from the mouth, has a recess 70 which is matched to the outer contour of the rolling body 53 and, in the open position according to FIG. 30, extends with its contour overlapping that of the recess 55 of the pressing lever 2.

To the rear of said recess 70, i.e. at the end which is directed away from the release pin 23, a shoulder remains as a result of the arrangement of the recess 70, said shoulder serving as blocking pin 38.

That end of the blocking slide 36 which is directed towards the release pin 23 is bevelled for the purpose of forming a latching pin 29 formed in one piece with said blocking slide. The sloping end surface resulting from this is designated 65.

Furthermore, the arrangement or alignment of the release pin 23 is selected such that the recess 60, which is provided with the run-on slope 61, is directed towards the blocking slide 36.

The monitoring device 13 which is illustrated in FIGS. 28 to 33 functions as follows:

In the open position according to FIG. 30, the spring-biassed blocking slide 36 is held in a standby position, this being brought about by rearward support of the blocking pin 38 on the rolling body 53, part of which projects into the bore 25. The release pin 23 is located in the stop-limited, spring-assisted initial position, in which it has its free end projecting beyond the end surface 18 of the rotary lever 2.

As the rotary levers are pivotally displaced in the direction of the closed position, the blocking slide 36 loses its support in the region of the rolling body 53, said rolling body leaves the bore 25 because of the pivoting displacement of the pressing lever 2 and thus releases the blocking pin 38. The compression spring 63 causes displacement of the blocking slide 36 in the direction of the release pin 23, whereupon, finally, the tip which forms the latching pin 29, and results from the sloping end surface 65, passes into the recess 60 of the release pin 23. In this position according to FIG. 31, the tip region of the sloping end surface 65 engages against the run-on slope 61 of the recess 60.

The blocking pin 38 is now located in the region of the top of the rolling body 53, which prevents rotary displacement of the pressing levers 2 into the open position by support of the blocking pin 38 on the rolling body 52. As can be seen, in particular, from FIG. 31, the blocking pin 38 has moved into the free space 57, which is formed between the recess 55 of the pressing lever 2 and the rolling body 53. Here too, the pressing lever 2 preferably remains in a partially open position with an opening angle alpha of approximately 10°. As a result of the blocking, the pressing tool 1 cannot be withdrawn from the blank. However, as in the above-described exemplary embodiments, emergency unlocking is conceivable in this case also.

As the closing movement of the pressing levers 2 continues, the release pin 23 is subjected to the action of the stop 17 such that the same is displaced back counter to the force of the compression spring 24, and, during this rearward displacement, the blocking slide 36 is displaced over the run-on slope 61 into a release position of the blocking pin 38 and finally, in a spring-assisted manner, moves by way of its tip, which is formed as a latching pin 29, into the latching recess 62 of the release pin 23 for the self-retaining action of the release pin 23 and blocking slide 36.

From this position, the pressing levers 2 can be pivoted into the open position. The displaced-back blocking pin 38 allows such a rotary displacement since said blocking pin has more or less left the free space 57 between the rolling body 53 and rotary-lever recess 55.

Figure 33:
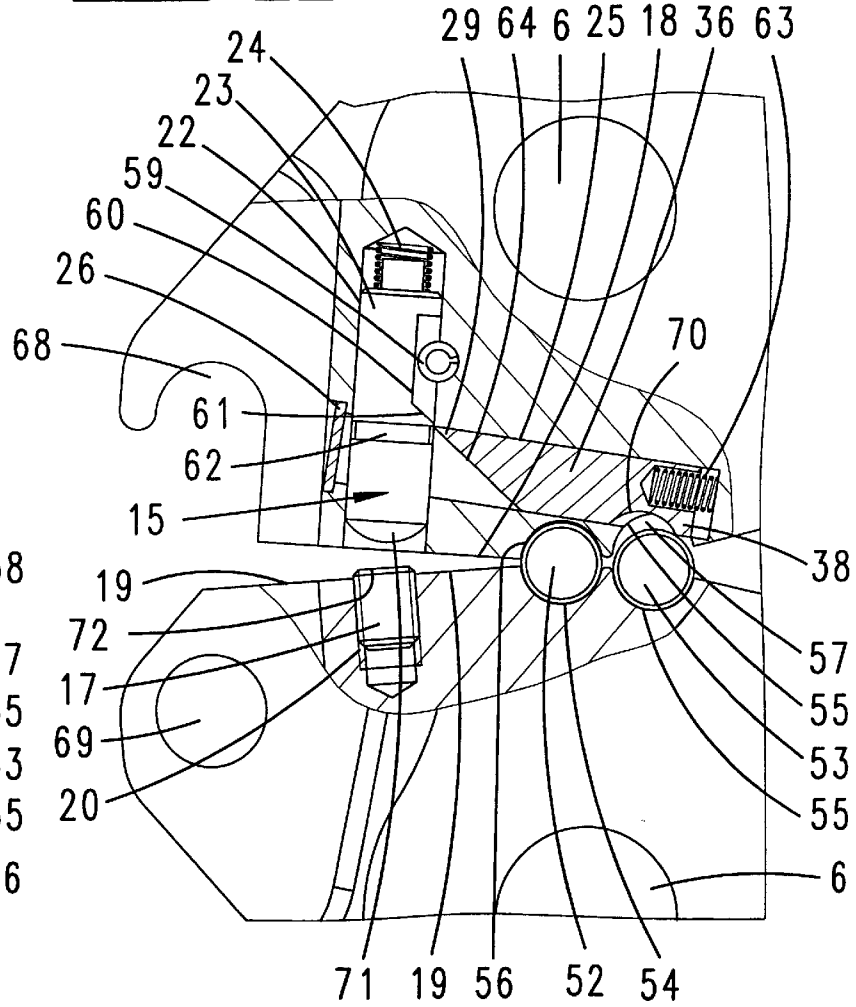
FIG. 33 shows an intermediate position of the pressing levers during an opening movement of the same following completion of closure according to FIG. 32.
Figure 32:
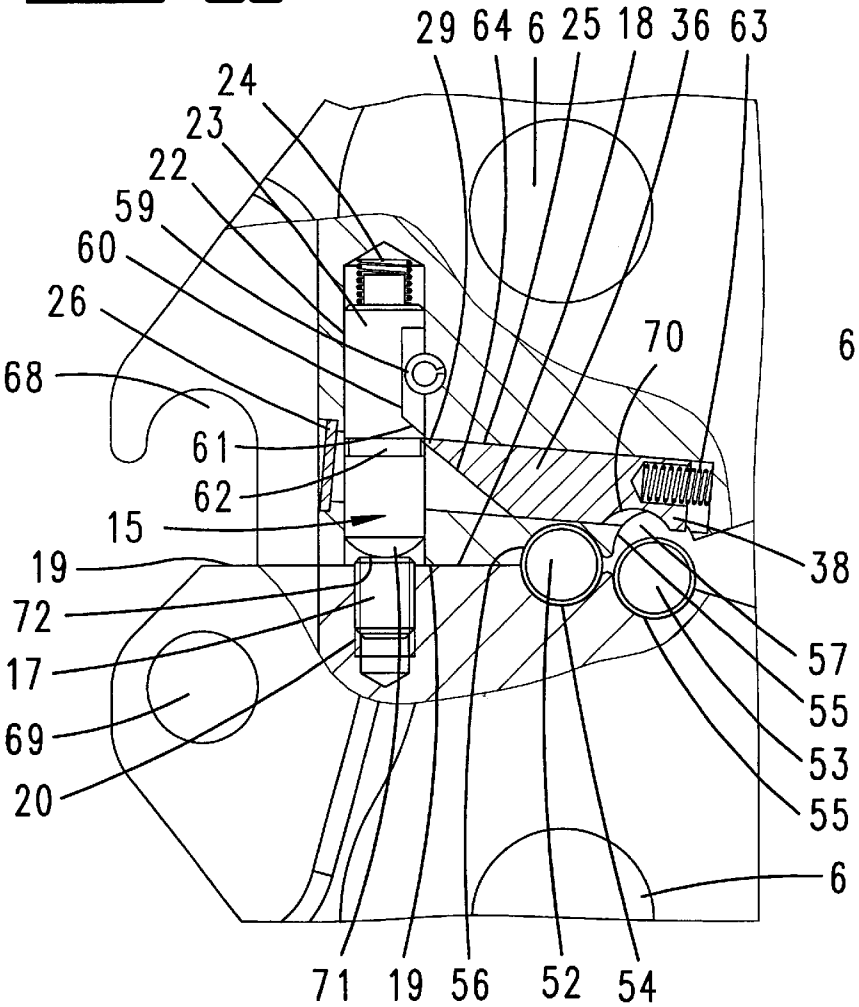
FIG. 32 shows the closed position of the pressing levers.

If the pressing levers 2, during the opening movement, reach an opening angle as is illustrated in FIG. 33, then the blocking pin 38 moves onto the rolling body 53, on the far side of the highest point, which, as the opening pivoting movement continues, results in further reverse displacement of the blocking slide 36. As a result of this, the tip or the latching pin 29 leaves the latching recess 62 for release of the release pin 23. Thereafter, the latter is displaced back automatically into the sensor position. The monitoring device 13 is reactivated thereafter.

The monitoring device 13 which is illustrated with reference to this closing-chain pressing tool is also conceivable in the case of a pressing tool with pressing jaws 3 or pressing-jaw inserts 48.

Irrespective of the embodiment selected, it is also pertinent that the displaceable pins and slides which cause the pressing levers 2 to be locked and/or released are integrated in a pressing lever 2. Provision is made at least for the monitoring device 13 to be disposed in a sunken or planar manner in relation to the outer surface of the pressing levers 2. This also applies to the sensor 15 and the stop 17, with the possible exception of the sensor tip 71 and stop surface 72, which project beyond the end surfaces 18 and 19.

All features disclosed are pertinent to the invention. The disclosure content of the associated/ accompanying priority documents (copy of the prior application) is hereby also included as to its full content in the disclosure of the application, also for the purpose of incorporating features of these documents in claims of the present application.

What is claimed is:

1. A pressing tool comprising:

pressing levers having upper, free mouth ends;

a connecting link plate which connects said pressing levers to one another, said pressing levers capable of being rotated in a tong-like manner:

a monitoring device, said monitoring device allowing said pressing levers to be in an open position, which is suitable for the release of a blank, if a full pressing action, with a minimum closing position of said pressing levers being achieved in the process, has been carried out beforehand; and a mechanical sensor being disposed on one of said pressing levers for checking the relative positioning of said pressing levers in relation to one another, said mechanical sensor being disposed in said upper, free mouth end of said one pressing lever, said mechanical sensor triggering mechanical locking between said connecting link plate and said one pressing lever.

2. A pressing tool as defined in claim 1, wherein said pressing levers are connected to one another such that they can be rotated in a tong-like manner, with the interposition of a rolling body, said sensor interacting with a blocking slide which has a blocking pin, said blocking pin, if the pressing action is incomplete, prevents an opening movement of said pressing levers about said rolling body.

3. A pressing tool as defined in claim 2, wherein associated recesses for said rolling body are formed in said pressing levers such that a free space is left between said recesses and said rolling body during the closure of said pressing levers, said blocking pin, which has moved into said free space, can only be moved into a release position by movement of a release pin which takes place during a full pressing action.

4. A pressing tool as defined in claim 3, wherein two rolling bodies with associated recesses are disposed beside one another in said pressing levers at different distances from a pressing mouth.

5. A pressing tool as defined in claim 4, wherein said blocking pin interacts with said rolling body which is further away from said pressing mouth.

6. A pressing tool as defined in claim 3, wherein, following an incomplete pressing action, the release position of said blocking pin can be achieved by an emergency unlocking action.

7. A pressing tool as defined in claim 6, wherein said emergency unlocking action acts on said release pin, which can displace said blocking pin into the release position.

8. A pressing tool as defined in claim 6, wherein said emergency unlocking action takes place by displacement of an adjustable stop, which acts on said release pin.

9. A pressing tool as defined in claim 8, wherein for emergency unlocking, a handle can be associated with at least one of said release pin, said adjustable stop, or said blocking pin.

10. A pressing tool as defined in claim 9, wherein said handle is formed as an extension of at least one of said blocking pin or said blocking slide, said handle projecting laterally beyond said one pressing lever for the pulling or pushing actuation of at least one of said blocking pin or said blocking slide.

11. A pressing tool as defined in claim 6, wherein said emergency unlocking action acts directly on said blocking pin.

12. A pressing tool as defined in claim 1, wherein said sensor, in a case of incorrect closure of said pressing levers, triggers a locking mechanism in a region of said connecting link plate, said locking mechanism being covered towards the outside by said connecting link plate.

13. A pressing tool as defined in claim 1, wherein said monitoring device is disposed in its entirety in an interior of said one pressing lever.

14. A pressing tool as defined in claim 1, wherein said monitoring device is disposed in a sunken manner in relation to an outer surface of said one pressing lever.

15. A pressing tool as defined in claim 1, wherein said sensor, with the possible exception of a sensor tip, is disposed in an interior of said one pressing lever.

16. A pressing tool as defined in claim 1, wherein said sensor is disposed in a sunken relation to an outer surface of said one pressing lever.

17. A pressing tool as defined in claim 1, wherein, disposed in said one pressing lever, is a blocking slide having a blocking pin projecting into a recess of said connecting link plate, said blocking pin, if the pressing action is incomplete, runs against a blocking projection portion in said recess of said connecting link plate.

18. A pressing tool as defined in claim 17, wherein said blocking slide projects under biasing action into a blocking position of said blocking pin, said biasing action can only be released in the case of full pressing action.

19. A pressing tool as defined in claim 18, wherein said blocking pin is spring-biased into said blocking position.

20. A pressing tool as defined in claim 17, wherein said blocking slide is subjected to an action of a latching pin, said latching pin, in the case of full pressing action, displaces said blocking slide into a release position.

21. A pressing tool as defined in claim 20, wherein said blocking pin, in the release position, is secured by latching.

22. A pressing tool as defined in claim 21, wherein the latching of said blocking pin is released during the opening movement.

23. A pressing tool as defined in claim 20, wherein said latching pin is formed in one piece with said blocking slide.

24. A pressing tool as defined in claim 20, wherein said latching pin is biased into the release position of said blocking slide, said biasing being relieved in the case of full pressing action.

25. A pressing tool as defined in claim 20, wherein said latching pin is urged by a release pin into a blocking position, in which the biasing is inhibited, said release pin being subjected to the action of said other one of said pressing levers, the biasing is relieved for the purpose of displacing said blocking slide into the release position.

26. A pressing tool as defined in claim 25, wherein an adjustable stop for said release pin is disposed in said other one of said pressing levers.

27. A pressing tool as defined in claim 26, wherein when said pressing levers are moved together, said release pin and said stop project beyond associated end surfaces of said pressing levers.

28. A pressing tool as defined in claim 25, wherein said release pin has a run-on slope associated with said latching pin into the release position during a pressing action.

29. A pressing tool as defined in claim 25, wherein said release pin has a run-on slope associated with said blocking slide into the release position during a pressing action.

30. A pressing tool as defined in claim 25, wherein said latching pin engages in a latching recess of said release pin following displacement into the release position.

31. A pressing tool as defined in claim 25, wherein said release pin is biased into a sensor position.

32. A pressing tool as defined in claim 25, wherein said release pin, which can be released at an angle to said blocking pin, has a run-on slope which, in the case of full pressing action, moves said blocking pin into the release position.

33. A pressing tool as defined in claim 1, wherein said mechanical locking is achieved by a blocking pin which is guided in said one pressing lever and projects into a recess provided in said connecting link plate which is directed towards said one pressing lever.

34. A pressing tool comprising:

pressing levers having mouth ends;

a connecting link plate which connects said pressing levers to one another, said pressing levers capable of being rotated in a tong-like manner;

a monitoring device, said monitoring device allowing said pressing levers to be in an open position, which is suitable for the release of a blank, if a full pressing action, with a minimum closing position of said pressing levers being achieved in the process, has been carried out beforehand; and a mechanical sensor being disposed on one of said pressing levers for checking the relative positioning of said pressing levers in relation to one another, said mechanical sensor, in a case of incorrect closure of said pressing levers, triggering a mechanical locking mechanism in a region of said connecting link plate, said locking mechanism being covered towards the outside by said connecting link plate.

35. A pressing tool as defined in claim 34, wherein said sensor is disposed in said mouth end of said one pressing lever.

36. A pressing tool comprising:

pressing levers having upper, free mouth ends;

a connecting link plate which connects said pressing levers to one another, said pressing levers capable of being rotated in a tong-like manner;

a monitoring device, said monitoring device allowing said pressing levers to be in an open position, which is suitable for the release of a blank, if a-full pressing action, with a minimum closing position of said pressing levers being achieved in the process, has been carried out beforehand; and a mechanical, electronic or electrical sensor being disposed on one of said pressing levers for checking the relative positioning of the pressing levers in relation to one another, said sensor, with the exception of a sensor tip, being disposed in an interior of said one pressing lever, said sensor being disposed in a sunken manner in relation to an outer surface of said one pressing lever, and said sensor being disposed in said upper, free mouth end of said one pressing lever.

37. A pressing tool comprising:

pressing levers having upper, free mouth ends;

a connecting link plate which connects said pressing levers to one another, said pressing levers capable of being rotated in a tong-like manner;

a monitoring device, said monitoring device allowing said pressing levers to be in an open position, which is suitable for the release of a blank, if a fall pressing action, with a minimum closing position of said pressing levers being achieved in the process, has been carried out beforehand; and a mechanical, electronic or electrical sensor being disposed on one of said pressing levers for checking the relative positioning of the pressing levers in relation to one another, said sensor being disposed in an interior of said one pressing lever, said sensor being disposed in a sunken manner in relation to an outer surface of said one pressing lever, and said sensor being disposed in said upper, free mouth end of said one pressing lever.

* * * * *

UNITED STATES PATENT AND TRADEMARK OFFICE

CERTIFICATE OF CORRECTION

PATENT NO. : 6,457,338 B1
DATED : October 1, 2002
INVENTOR(S) : Egbert Frenken

It is certified that error appears in the above-identified patent and that said Letters Patent is hereby corrected as shown below:

Column 12,
Line 56, “in he” should be -- in the --

Column 22,
Line 21, “fall” should be -- full --

Signed and Sealed this

Fourth Day of March, 2003

JAMES E. ROGAN
*Director of the United States Patent and Trademark Office*